US006419540B1

(12) United States Patent
Tanaka et al.

(10) Patent No.: US 6,419,540 B1
(45) Date of Patent: Jul. 16, 2002

(54) PLASMA DISPLAY PANEL SUITABLE FOR HIGH-QUALITY DISPLAY AND PRODUCTION METHOD

(75) Inventors: Hiroyoshi Tanaka, Kyoto; Ryuichi Murai, Toyonaka; Hideaki Yasui, Hirakata; Yoshiki Sasaki, Katano; Akira Shiokawa, Osaka; Masatoshi Kudoh, Hirakata; Koichi Kotera, Osaka; Masaki Aoki, Minoo; Mitsuhiro Ohtani, Sakai; Shigeo Suzuki, Hirakata; Kinzou Nonomura, Ikoma, all of (JP)

(73) Assignee: Mastushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/965,278

(22) Filed: Sep. 26, 2001

Related U.S. Application Data

(62) Division of application No. 09/692,437, filed on Oct. 19, 2000, which is a division of application No. 08/979,752, filed on Dec. 12, 2000, now Pat. No. 6,160,345.

(30) Foreign Application Priority Data

Nov. 27, 1996 (JP) ..... 8-315955
Jun. 2, 1997 (JP) ..... 9-143635

(51) Int. Cl.[7] ..... H01J 9/02
(52) U.S. Cl. ..... 445/24; 445/58
(58) Field of Search ..... 445/24, 58

(56) References Cited

U.S. PATENT DOCUMENTS 4,454,449 A 6/1984 Hall
4,794,308 A 12/1988 Ernsthausen
5,326,298 A 7/1994 Hotomi
5,684,361 A 11/1997 Seki
5,703,437 A 12/1997 Komaki
5,791,960 A * 8/1998 Fukuta et al. ..... 445/24
5,929,464 A * 7/1999 Yamazaki et al. ..... 257/72

FOREIGN PATENT DOCUMENTS

JP 62194225 8/1987
JP 7105855 4/1995

OTHER PUBLICATIONS

New Ceramics (1995) No. 3.
Electronic Display Forum 97, pp. 6–8, Apr. 16–18, 1997.
Electronic Ceramics 26 (126), 1995.
Display and Imaging, vol. 14, pp. 96–98 and pp. 99–100, 1996.

* cited by examiner

*Primary Examiner*—Kenneth J. Ramsey
(74) *Attorney, Agent, or Firm*—Price and Gess

(57) ABSTRACT

A PDP does not suffer from dielectric breakdown though a dielectric layer is thin, with the problems of conventional PDPs, such as cracks appearing in the glass substrates during the production of the PDP being avoided. To do so, the surface of silver electrodes of the PDP is coated with a 0.1–10 $\mu$m layer of a metallic oxide, on whose surface OH groups exist, such as ZnO, $ZrO_2$, MgO, $TiO_2$, $Al_2O_3$, and $Cr_2O_3$. The metallic oxide layer is then coated with the dielectric layer. It is preferable to form the metallic oxide layer with the CVD method. The surface of a metallic electrode can be coated with a metallic oxide, which is then coated with a dielectric layer. The dielectric layer can be made of a metallic oxide with a vacuum process method or the plasma thermal spraying method. The dielectric layer formed on electrodes with the CVD method is remarkably thin and flawless. When the dielectric layer is formed with the vacuum process method or the plasma spraying method, warping and cracks conventionally caused by baking the dielectric layer are prevented. Here, borosilicate glass including 6.5% or less by weight of alkali can be used as the glass substrate.

4 Claims, 10 Drawing Sheets

PLASMA DISPLAY PANEL SUITABLE FOR HIGH-QUALITY DISPLAY AND PRODUCTION METHOD

This is a divisional application of U.S. Ser. No. 09/692,437 filed Oct. 19, 2000, that is a divisional application of U.S. Ser. No. 08/979,752, issued as U.S. Pat. No. 6,160,345 on Dec. 12, 2000.

BACKGROUND OF THE INVENTION (1) Field of the Invention

This invention relates to a plasma display panel used as a display device and the production method, and in particular to a plasma display panel suitable for a high-quality display.

(2) Description of the Prior Art

Recently, as expectations for high-quality and large-screen TVs such as high-vision TVs have increased, displays suitable for such TVs, such as CRT, Liquid Crystal Display (LCD), and Plasma Display Panel (PDP), have been developed.

CRTs have been widely used as TV displays and excel in resolution and picture quality. However, the depth and weight increase as the screen size increases. Therefore, CRTs are not suitable for large screens exceeding 40 inch in size. LCDs have high performance such as low power consumption and low driving voltage. However, producing a large LCD is technically difficult and the viewing angles of LCDs are limited.

On the other hand, it is possible to produce a large-screen PDP with a short depth, and 40-inch PDP products have already been developed.

PDPs are divided into two types: Direct Current type (DC type) and Alternating Current type (AC type). Currently, PDPs are mainly AC type since these are suitable for large screens.

FIG. 1 shows a perspective view of a conventional AC PDP.

In FIG. 1, the element 101 is a front glass substrate (front panel) and the element 105 is a back glass substrate (back panel). These substrates are made of soda lime glass.

The front glass substrate 101 with display electrodes 102 thereon is covered with a dielectric glass layer 103, which functions as a capacitor, and with a magnesium oxide (MgO) dielectric protecting layer 104.

The back glass substrate 105 with address electrodes 106 thereon is covered with a dielectric glass layer 107. Partition walls 108 are attached onto the dielectric glass layer 107 and fluorescent substance layers 109 are inserted between the Partition walls 108. Discharge gas is injected into discharge spaces 110 sealed by the front glass substrate 101, the back glass substrate 105, and the partition walls 108.

Silver electrodes or Cr—Cu—Cr electrodes are used as the display electrodes 102 and the address electrodes 106. The silver electrodes can be easily formed with the printing method.

As the demand for high-quality displays has increased, PDPs with minute cell structures have been desired.

For instance, in conventional 40-inch TV screens of National Television System Committee (NTSC) standard, the number of cells is 640×480, cell pitch 0.43 mm×1.29 mm, and area of one cell about 0.55 $mm^2$. On the contrary, in 42-inch high-vision TVs, the number of cells is 1920×1125, cell pitch 0.15 mm×0.45 mm, and area of one cell 0.072 $mm^2$.

In a minute cell structure, the distance between discharge electrodes (display electrodes) becomes short and the discharge space small. As a result, it is necessary to make the dielectric layer thinner than conventional one to maintain as large capacitance of the dielectric layer as conventional one.

However, glass used for the dielectric glass layer, such as lead oxide glass or bismuth oxide glass, has inferior wettability with metal materials used for electrodes. Therefore, it is difficult to coat these electrodes with a thin and even dielectric glass layer and these electrodes have a problem concerning withstand voltage. Since there are prominent projections and depressions on the surface of silver electrodes, in comparison with Cr—Cu—Cr electrodes, it is particularly difficult to coat the silver electrodes with a thin and even dielectric layer and the withstand voltage problem is notable.

With regard to the above problems, Japanese Laid-Open Patent Application No. 62-194225 discloses a technique to form a thin and even dielectric layer by forming an inter-layer between electrodes and a dielectric layer. The inter-layer is formed by applying $SiO_2$ and $Al_2O_3$ on a substrate with an electrode before a dielectric glass layer is formed.

This disclosure describes specific methods for forming the inter-layer. According to the disclosure, the inter-layer is formed by applying silica solution onto the surface to have 500–1000 A thickness with the spin-coat method or the dipping method, and by baking the layer. The Japanese Application also discloses another method in which a material of the inter-layer is applied onto the surface by the EB (electron beam) evaporation method or the sputtering method.

Although the above techniques improve the withstand voltage to a certain extent, further improvement in the withstand voltage is desirable.

When a PDP having the structure in FIG. 1 is produced, electrodes, dielectric layers, and partition walls are formed in that order on a glass substrate made of soda lime glass. In each step of the above formation, a material is applied onto the surface and is then baked with some method.

For instance, a dielectric layer 103 is formed by applying lead-oxide-based glass material onto the surface to have a thickness ranging from 20 $\mu$m to 30 $\mu$m and by baking the applied glass material (see Japanese Laid-Open Patent Application No. 7-105855), where the lead-oxide-based material includes lead oxide (PbO), boron oxide ($B_2O_3$), silicon dioxide ($SiO_2$), zinc oxide (ZnO), and aluminum oxide ($Al_2O_3$), and has relatively low melting point in a range of 500 to 600° C. and a thermal expansion coefficient in a range of $80\times10^{-7}$/° C. to $83\times10^{-7}$/° C.

The Partition walls are also formed by applying glass materials with the screen printing method and baking the applied glass materials.

When a thin glass substrate is used, electrodes, partition walls, dielectric layers, and fluorescent substance layers may crack or the glass substrate may warp or shrink when they are baked at heating temperature of 500–600° C. Thermal expansion coefficients of their materials are different so that, when the materials are heated, Partition walls, dielectric layers, and the like are distorted and cracks are easily caused in dielectric layers and partition walls. The cracks caused in the dielectric layers reduce the withstand voltage.

In view of the above problems, it is necessary to use a glass substrate with a certain thickness, which becomes a factor for increasing the weight of a large-screen PDP.

For instance, for a 42-inch TV, the size of the glass substrate is about 97 cm×57 cm, and, to prevent warping and shrinkage, the thickness is set to about 2.6–2.8 mm.

The specific gravity of the glass is 2.49 g/cm$^3$ so that, if the substrate is 2.7 mm in thickness, the total weight of the front and back glasses is about 7.4 Kg and the weight of the panel to which circuits are attached exceeds 10 Kg (see Display And Imaging, Vol.14, PP96–98, 1996, for instance).

Regarding these problems, a glass substrate having a relatively high distortion point has been developed (PD-200 made by Asahi Glass co. has the distortion point of 570° C., for instance). By using this glass substrate, it is possible to reduce deformations, such as warping and shrinkage, of the glass substrate in the heat treatment (see Display And Imaging, Vol.14, PF99–100, 1996, for instance).

The specific gravity of this PD-200 glass is, however, 2.77 g/cm$^3$ and this value is greater than 2.49 g/cm$^3$, which is the specific gravity of soda lime glass. The Young's modulus of PD-200 glass is greater than that of soda lime glass and the thermal expansion coefficient of PD-200 is $84\times10^{-7}$/° C., similar to that of soda lime glass. As a result, using such a glass having a high distortion point does not significantly reduce the panel weight (see Electric Display Forum 97, P6–8, Apr. 16–18, 1997, for instance).

SUMMARY OF THE INVENTION

The first object of the present invention is to provide a PDP having high brightness and high reliability with a minute cell structure, which is achieved by preventing dielectric breakdown even when a thin dielectric layer is used, and a method for producing the PDP.

The second object of the present invention is to provide a PDP produced with less cracks and waviness in glass substrates and with less cracks in dielectric layers and partition walls, even if the thickness of the glass substrate is thinner than conventional one, and a method for producing the PDP.

The first object is achieved by forming a 0.1–10 $\mu$m coat made of a metallic oxide, on whose surface OH groups is generated, on the surface of silver electrodes and by applying a dielectric layer onto the front or back panel loading the silver electrodes.

The metallic oxide, on whose surface OH groups are generated, is ZnO, $ZrO_2$, MgO, $TiO_2$, $SiO_2$, $Al_2O_3$, and $Cr_2O_3$, for instance, and a 0.1–2 $\mu$m coat can be formed on the surface of the first electrode with the Chemical Vapor Deposition (CVD) method.

The layer made of the metallic oxide, on whose surface OH groups are generated, with the CVD method has a good wettability with electrodes, which are the substrate of the layer, and is also dense. Further, this metallic oxide has OH groups on its surface (see Color Materials, Vol.69, No.9. P55–63, 1996), so that the metallic oxide has good wettability with lead oxide glass and bismuth oxide glass.

As a result, it is possible to form a thin dielectric layer which is even and dense on silver electrodes having projections and depressions. Therefore, the above structure produces an effect that it is hard to cause dielectric breakdown, even if the dielectric layer is thinner than 15 $\mu$m, namely thinner than a conventional layer.

Therefore, with the above structure, it is possible to decrease discharge voltage, and to improve panel brightness and the reliability of PDPs.

The first object is also achieved by forming a metallic oxide coat made of a metallic oxide on the surface of metallic electrodes and forming a dielectric layer on the metallic oxide coat, instead a dielectric layer is formed directly on the metallic electrodes on the front or back panel of a PDP.

The first object is still achieved by forming a dielectric layer made of a metallic oxide on electrodes on the front or back panel of a PDP with a vacuum process method or forming a dielectric layer with the plasma spraying method.

The "vacuum process method" represents a method for forming a thin coat in vacuum state and, more specifically, a method such as the CVD method, the sputtering method, or the EB evaporation method.

In particular, with the CVD method, a thin and flawless dielectric layer can be formed on electrodes.

When a dielectric layer is formed with the vacuum process method or the plasma spraying method, these methods do not require a baking step which is necessary for forming the dielectric layer with the conventional printing method so that warping and cracks in a panel due to baking of the dielectric layer can be prevented, thereby achieving the second object. When the partition walls are formed with the plasma spraying method, it is not necessary to bake the partition walls so that the second object is achieved.

When borosilicate glass including 6.5% or less by weight of alkali is used as the material for a glass substrate used for the front and back panels of a PDP, it is hard to cause cracks and waviness in the glass substrate due to baking during the production of the PDP even if the thickness of the panel is thinner than 2 mm, resulting in further effect on the second object. For the second object, it is particularly preferable to use borosilicate glass whose distortion point is 535° C. or more and thermal expansion coefficient $51\times10^{-7}$/° C. or less.

BRIEF DESCRIPTION OF THE DRAWINGS

These and other objects, advantages and features of the invention will become apparent from the following description thereof taken in conjunction with the accompanying drawings which illustrates a specific embodiment of the invention. In the drawings.

DESCRIPTION OF THE PREFERRED EMBODIMENTS

The following is a description of the preferred embodiments of the present invention.

{Embodiment 1}

Figure 1:
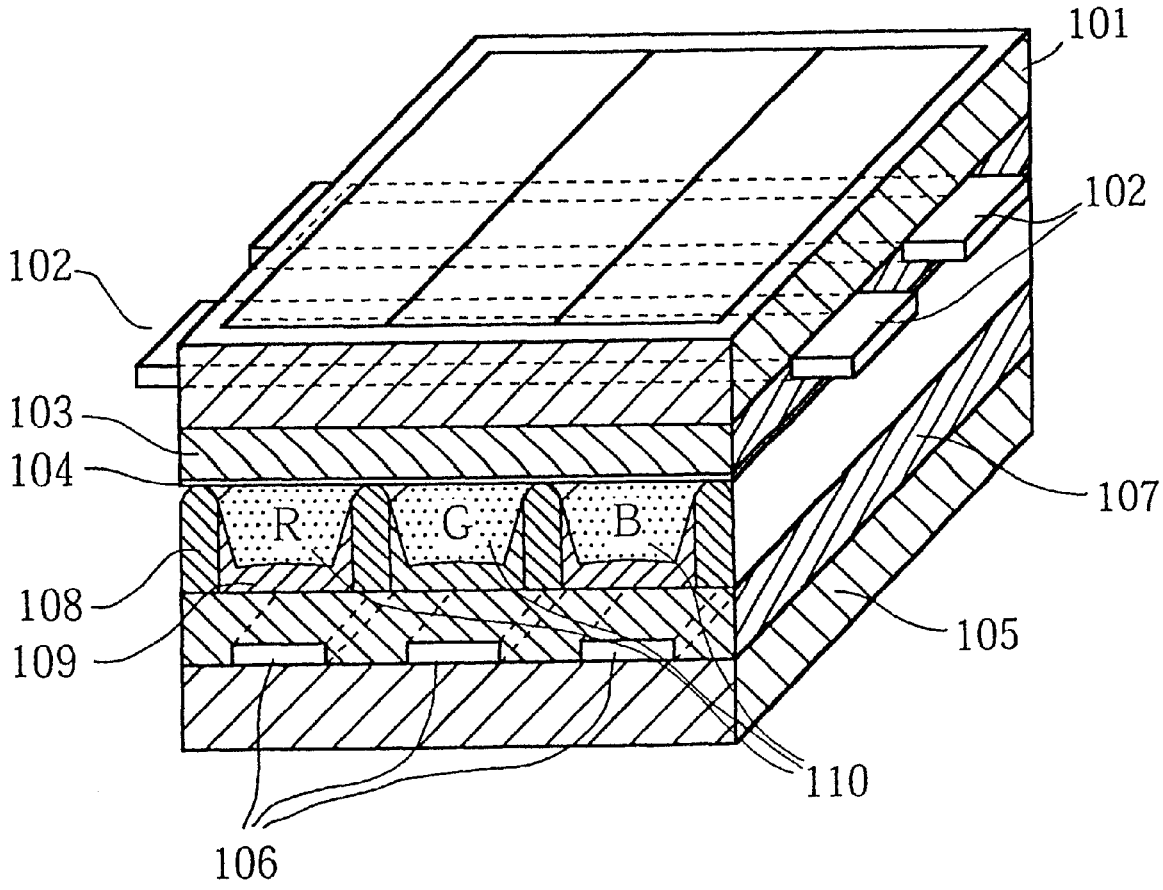
FIG. 1 is a perspective view of a conventional AC PDP.
Figure 2:
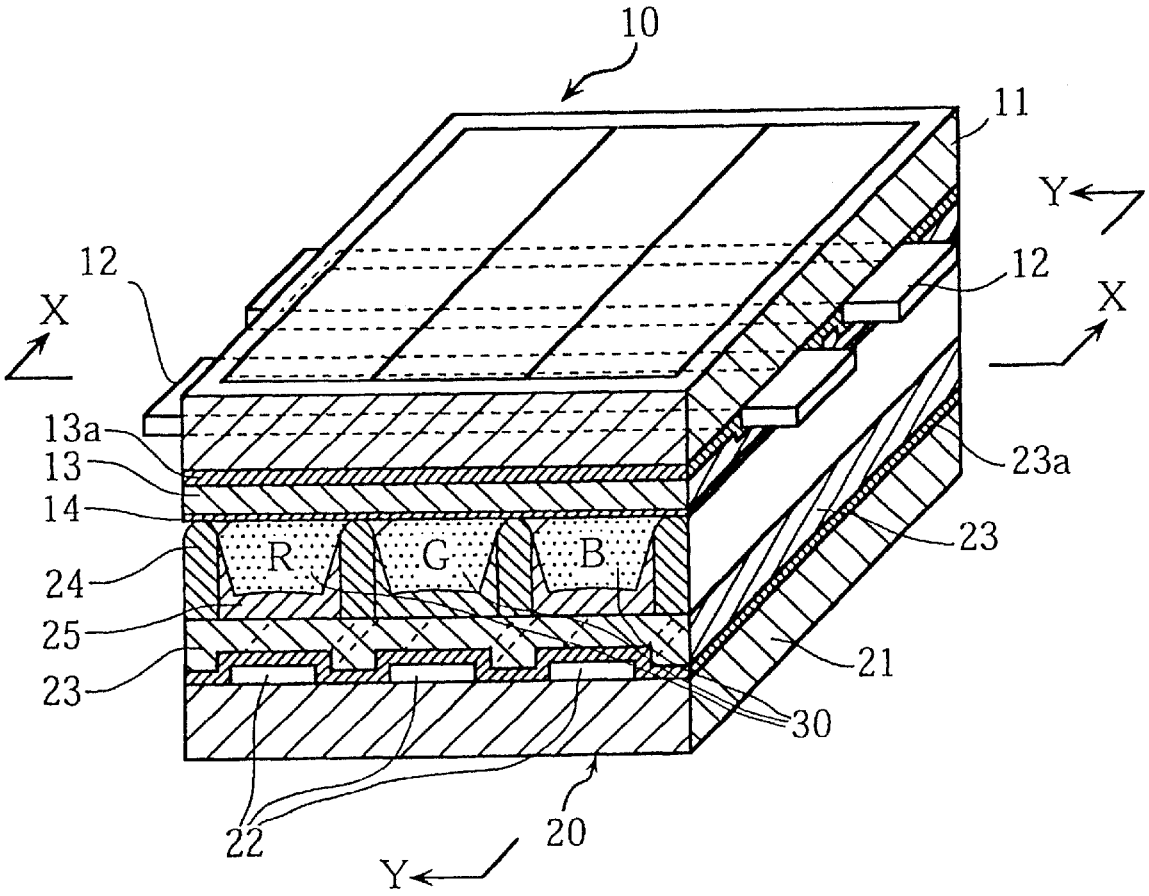
FIG. 2 is a perspective view of an AC PDP of the embodiment.
Figure 3:
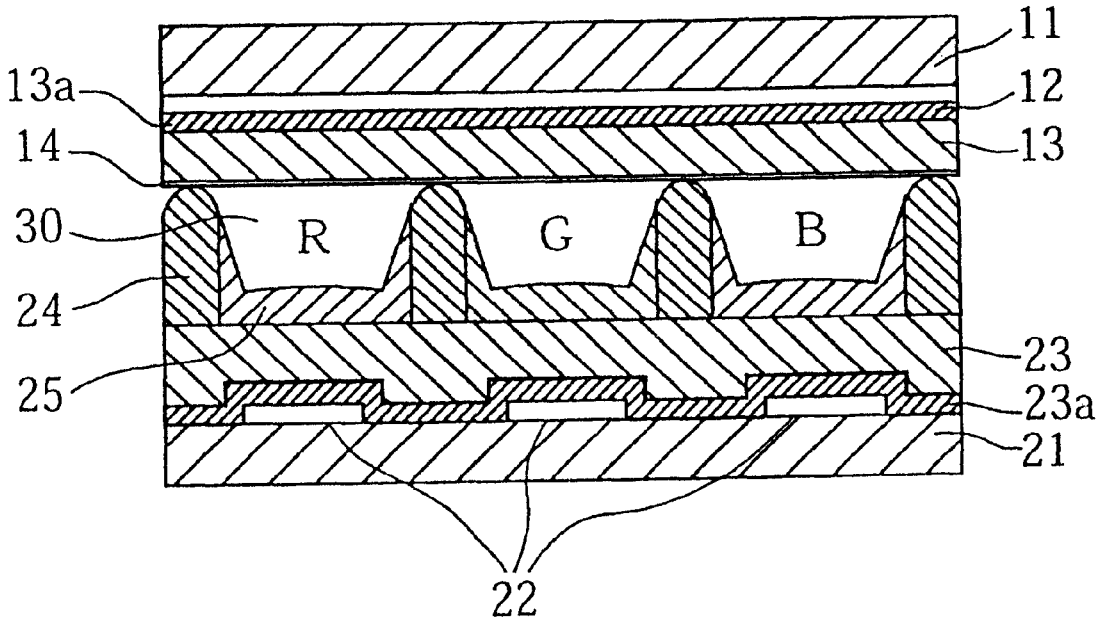
FIG. 3 is a sectional view in the direction of the arrow X in FIG. 2.
Figure 4:
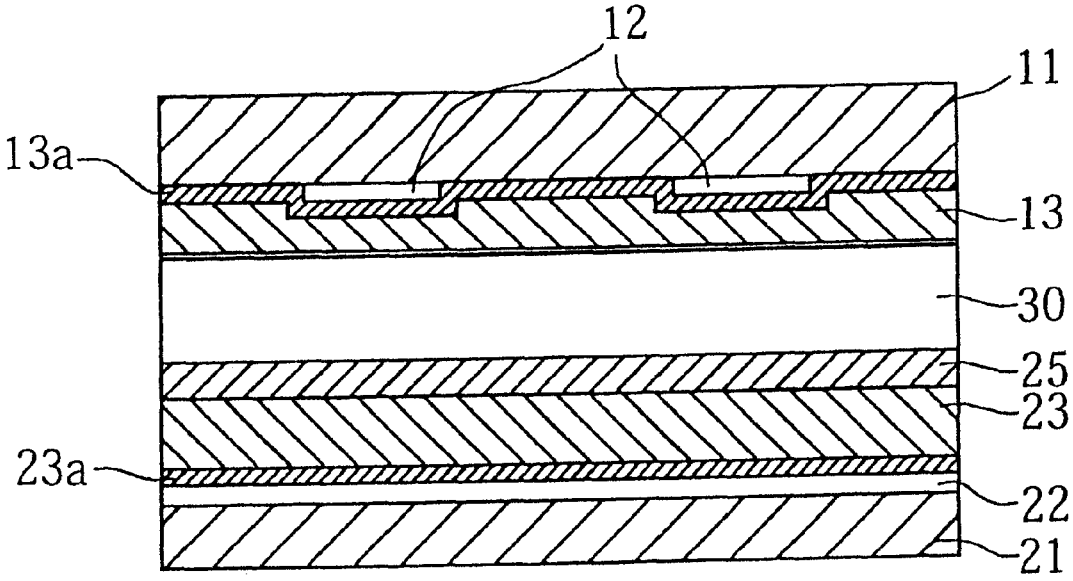
FIG. 4 is a sectional view in the direction of the arrow Y in FIG. 2.

FIG. 2 is a perspective view of the AC PDP of the present invention. FIG. 3 is a sectional view in the direction of the arrow X in FIG. 2. FIG. 4 is a sectional view in the direction of the arrow Y in FIG. 2.

Though each of the drawings shows only three cells for a simplified description, a PDP includes a number of cells which each emit red (R), green (G), or blue (B) light.

As shown in the drawings, the present PDP includes: a front panel 10 which is made up of the front glass substrate 11 with discharge electrodes (display electrodes) 12 made of silver, a metallic oxide layer 13*a*, and a dielectric glass layer 13; and a back panel 20 which is made up of the back glass substrate 21 with address electrodes 22, a metallic oxide layer 23*a*, a dielectric glass layer 23, partition walls 24, and R, G, or B fluorescent substance layer 25, where the front panel 10 and the back panel 20 are bonded together. Discharge spaces 30, which are sealed by the front panel 10, the back panel 20, and partition walls 24, are charged with a discharge gas. The present PDP is made as follows.

Producing the Front Panel 10

The front panel 10 is made by: forming discharge electrodes (display electrodes) 12 on the front glass substrate 11 to resemble stripes; then covering the display electrodes 12 and the front glass substrate 11 with the metallic oxide layer 13*a* with the CVD method; then forming the dielectric glass layer 13 of a glass material whose dielectric constant $\in$ is 10 or more on the metallic oxide layer 13*a*; and forming a protecting layer 14 on the dielectric glass layer 13.

Figure 5:
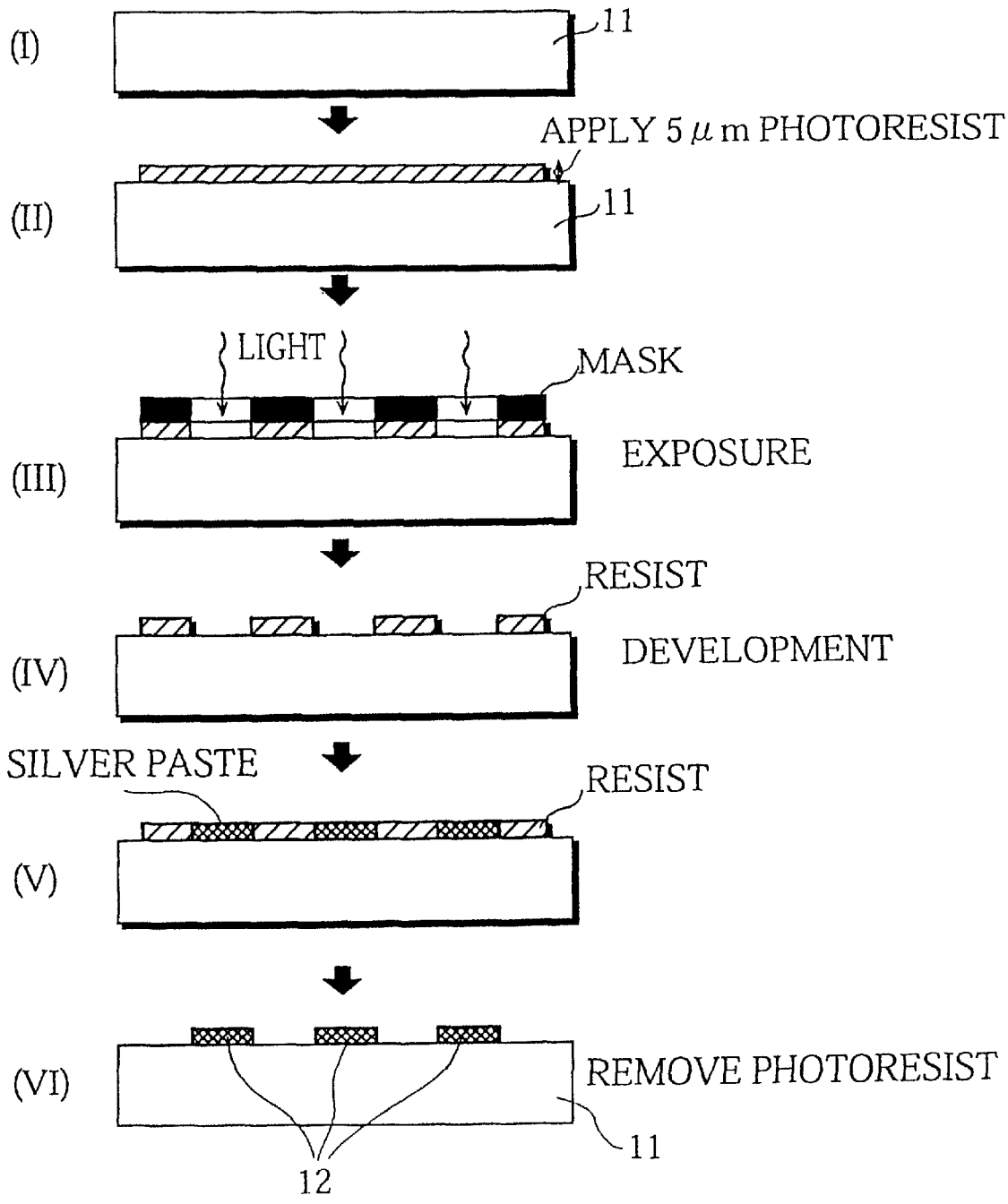
FIG. 5 shows a process for forming discharge electrodes with the photoresist method.

The following is a description of the production of the discharge electrodes 12 with the photoresist method, with reference to FIG. 5.

A photoresist is applied onto the front glass substrate 11 to form a layer having a thickness of 5 $\mu$m (see (II) in FIG. 5).

Only the parts of the photoresist located where the discharge electrodes 12 are to be formed is exposed (see (III) in FIG. 5). The photoresist is developed and the exposed parts of the photoresist is removed (see (IV) in FIG. 5).

A silver electrode paste is transferred with the screen printing method onto the part of the front glass substrate 11, where the photoresist has been removed (see (V) in FIG. 5).

After being dried, the remaining photoresist is removed from the glass substrate 11 with a remover or the like. The applied Ag is baked to form discharge electrodes 12 (see (VI) in FIG. 5).

Producing Metallic Oxide Layer, Dielectric Glass Layer, and Protecting Layer

Figure 6:
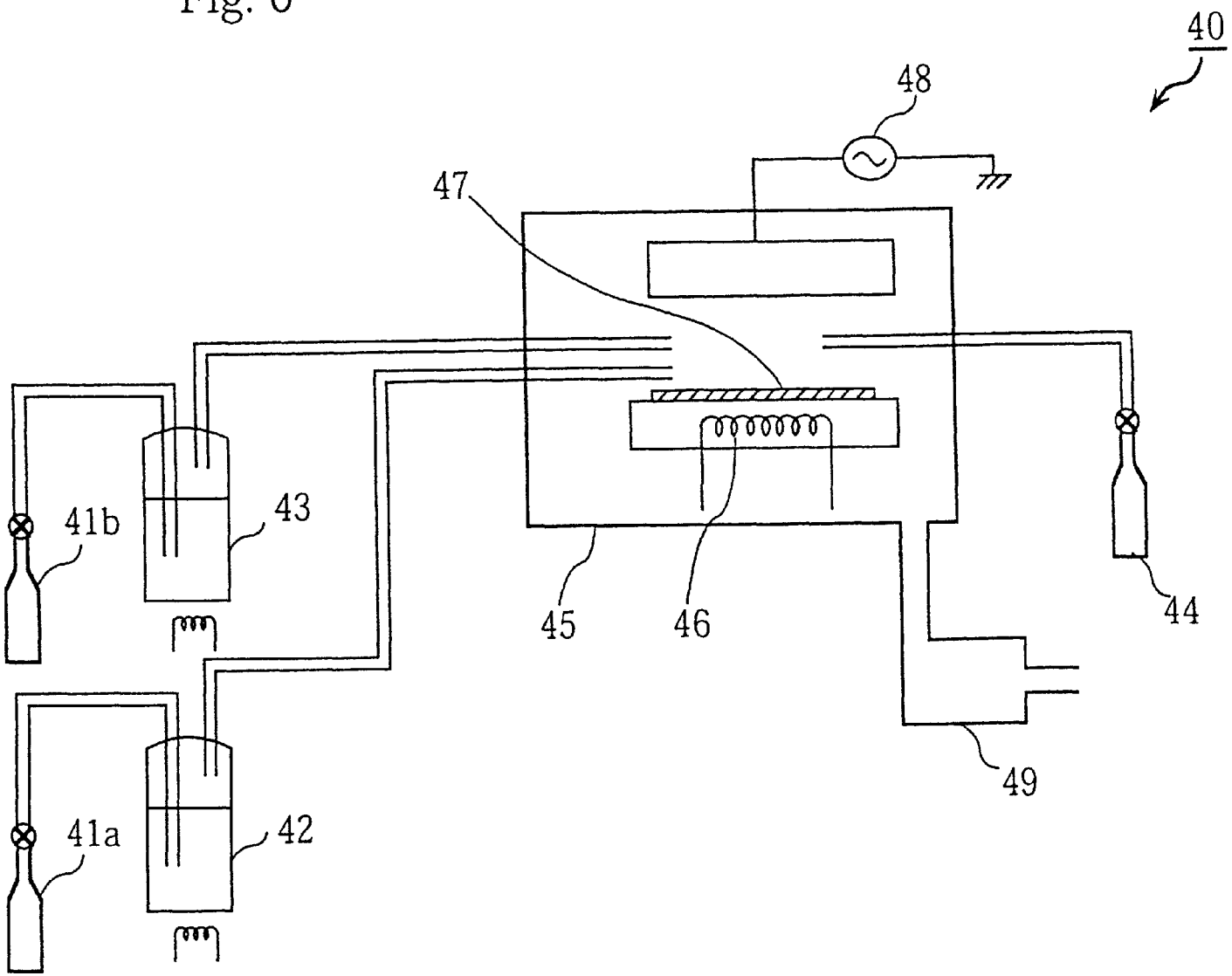
FIG. 6 is a simplified drawing of a CVD apparatus used for forming a metallic oxide layer and a protecting layer.

The following is a description of the production of the metallic oxide layer with the CVD method, with reference to FIG. 6.

FIG. 6 is a simplified drawing of the CVD apparatus for forming the metallic oxide layers 13*a* and 23*a* and the protecting layer 14.

The CVD apparatus can perform both thermal CVD and plasma CVD. The CVD apparatus 45 is provided with a heater 46 for heating the glass substrate 47, namely the front glass substrate 11 with the discharge electrodes 12 and the dielectric layer 13 in FIG. 2. The pressure in the CVD apparatus 45 can be reduced by an exhauster 49. A high-frequency power 48 for producing plasma is also provided in the CVD apparatus 45.

The Ar gas cylinders 41*a* and 41*b* supply Ar gas being a carrier into the CVD apparatus 45 through the bubblers 42 and 43.

The bubbler 42 stores heated metal chelate or alkoxide compound as a source material of the metallic oxide layer. By sending Ar gas from the Ar gas cylinder 41*a*, the source material is evaporated and is sent into the CVD apparatus 45.

The bubbler 42 stores a compound, such as zinc acetylacetone ($Zn(C_5H_7O_2)_2$) zirconium acetylacetone ($Zr(C_5H_7O_2)_4$), magnesium acetylacetone ($Mg(C_5H_7O_2)_2$), titanium acetylacetone ($Ti(C_5H_7O_2)_4$), TEOS ($Si(O^*C_2H_5)_4$), aluminium dipivaloyl methane ($Al(C_{11}H_{19}O_2)_3$), aluminium acetylacetone ($Al(C_5H_7O_2)_3$) chromium acetylacetone ($Cr(C_5H_7O_2)_3$), or a mixture of these materials.

The bubbler 43 stores a magnesium compound which is a material of the protecting layer. The magnesium compound is, for instance, magnesium acetylacetone ($Mg(C_5H_7O_2)_2$) or cyclopentadienyl magnesium ($Mg(C_5H_5)_2$).

The oxygen cylinder 44 supplies reaction gas, namely oxygen ($O_2$), into the CVD apparatus 45.

When the metallic oxide layer 13*a* is formed with the thermal CVD using the CVD apparatus, the glass substrate 47 is placed on the heater 46, with the surface having the electrodes looking upward. The glass substrate 47 is heated to a predetermined temperature (250° C.) and, at the same time, the pressure in the apparatus is reduced to under 100 Torr by the exhauster 49.

The Ar gas cylinder 41*a* sends Ar gas to the bubbler 42 while the bubbler 42 heats metal chelate or alkoxide compound to a predetermined temperature and the oxygen cylinder 44 supplies oxygen.

By doing so, the metal chelate or alkoxide compound sent into the CVD apparatus 45 reacts with oxygen so that the metallic oxide layer 13*a* is formed on the surface of the glass substrate 47 on which the electrodes have been formed.

On the other hand, when the metallic oxide layer 13*a* is formed with the plasma CVD using the CVD apparatus, a similar operation to the case of the thermal CVD is performed. However, in this case, the high-frequency power 48 is also driven to produce plasma. The metallic oxide layer 13*a* is formed by applying high-frequency electric field of 13.56 MHz while plasma is produced in the CVD apparatus 45.

By doing so, the metallic oxide layer 13*a* is made of a metallic oxide, such as zinc oxide (ZnO, $ZrO_2$), titanium oxide ($TiO_2$) aluminium oxide ($Al_2O_3$), silicon oxide ($SiO_2$), magnesium oxide (MgO), or chromium oxide ($Cr_2O_3$) By forming the metallic oxide layer 13*a* with the thermal or plasma CVD method as described above, the metallic oxide grow slowly on the glass substrate and the surface of the electrodes. Therefore, even if the surface of the electrodes have projections and depressions, the metallic oxide layer 13*a* is densely formed along projections and depressions on the surface of the electrodes. This metallic oxide layer 13*a* has high-grade adhesiveness and wettability with Ag, the material of the discharge electrodes 12, so that there are no bubbles in the metallic oxide layer 13*a*.

This metallic oxide has a characteristic that OH groups exist thereon so that OH groups exist on the metallic oxide layer 13*a*. As a result, the dielectric glass layer 13 formed on the metallic oxide layer 13*a* has good wettability.

Note that the thickness of the metallic oxide layer 13*a* is preferably set to 0.1–10 $\mu$m, in particular to 0.1–2 $\mu$m. It is preferable to form the metallic oxide layer 13*a* to have an amorphous structure.

The dielectric glass layer 13 made of glass having dielectric constant $\in$ of 10 or more is formed on the metallic oxide layer 13*a*.

A material of the dielectric glass layer 13 is lead oxide glass, bismuth oxide glass, or the like.

The composition of the lead oxide glass is, for instance, a mixture of lead oxide (PbO), boron oxide ($B_2O_3$), silicon dioxide ($SiO_2$), and aluminum oxide ($Al_2O_3$) And the composition of the bismuth oxide glass is, for instance, a mixture of bismuth oxide ($Bi_2O_3$), zinc oxide (ZnO), boron oxide ($B_2O_3$), silicon oxide ($SiO_2$), and calcium oxide (CaO).

By adding $TiO_2$ to the glass composition described above, it is possible to further improve the dielectric constant ∈.

When the amount of added $TiO_2$ is set to 5% or more by weight, the dielectric constant ∈ is noticeably improved and it is easy to obtain the value 13 or more as ∈ (see Table 1). However, when a content of $TiO_2$ exceeds 10% by weight, the light permeability of the dielectric glass layer declines so that it is preferable to set the content of $TiO_2$ in a range of 5 to 10% by weight.

The dielectric glass layer 13 is formed by producing a dielectric glass paste by mixing powder of a glass material and organic binder, then applying the paste on the surface of the metallic oxide layer 13*a* with the screen printing method, and baking the applied paste (at 540° C., for instance)

As described above, the discharge electrodes 12 are covered with the metallic oxide layer 13*a* made of a metal on whose surface OH groups exist. Therefore, the surface of the metallic oxide layer 13*a* has good wettability with glass so that an even dielectric glass layer which does not include bubbles is formed.

In the present embodiment, the thickness of the dielectric glass layer 13 is set to 15 μm or less which is thinner than conventional layer. This is because the panel brightness is improved and the discharge voltage is reduced as the dielectric glass layer 13 is thinner. Therefore, it is preferable to set the thickness as thin as possible within a range where withstand voltage does not decrease. This is described below.

On the assumption that the area of the display electrodes 12 is S, the thickness of the dielectric glass layer 13*d*, the dielectric constant of the dielectric glass layer 13 ∈, and the electric charge on the dielectric glass layer 13 Q, the electric capacity C between the display electrodes 12 and the address electrodes 22 is expressed by the following formula 1:

$$C=\in S/d. \qquad \text{<Formula 1>}$$

On the assumption that the voltage applied between the display electrodes 12 and the address electrodes 22 is V and the electric charge on the dielectric glass layer 13 on the display electrodes 12 is Q, the relation between V and Q is expressed by the following Formula 2:

$$V=dQ/\in S \qquad \text{<Formula 2>}$$

where the discharge space becomes an electric conductor because the discharge space is in a plasma state during discharging.

It is apparent from Formula 1 that as the thickness d becomes thinner, the electric capacity C increases. It is apparent from Formula 2 that as the thickness d becomes thinner, the discharge voltage V decreases.

More specifically, it is apparent that, by forming a thin dielectric glass layer, the electric capacity increases and the discharge voltage decreases.

The protecting layer 14 made of MgO is formed on the dielectric glass layer 13 with the CVD method, namely the thermal or Plasma CVD method.

More specifically, the protecting layer made of MgO is formed with the CVD apparatus and the same method as that for forming the metallic oxide layer, using the material in the bubbler 43.

The steps described above produce a magnesium oxide protecting layer with (100)-face orientation, including (200)-face orientation and (300)-face orientation, or a magnesium oxide protecting layer with (110)-face orientation.

Producing Back Panel 20

On the surface of the back glass substrate 21, an address electrodes 22 are formed with the photoresist method, namely the same method used to form the discharge electrodes 12.

As in the case of the production of the front panel 10, the metallic oxide layer 23*a* is formed on the address electrodes 22 with the CVD method. The same glass as that used for forming the dielectric glass layer 13 is screen printed and baked on the metallic glass layer 23*a* to produce the dielectric glass layer 23.

The partition walls 24 made of glass are attached onto the dielectric glass layer 23 with a predetermined pitch.

The fluorescent substance layers 25 are formed by inserting one of a red (R) fluorescent, a green (G) fluorescent, and a blue (B) fluorescent substance into each space between the partition walls 24. Though any fluorescent substance generally used for PDPs can be used for each color, the present embodiment uses the following fluorescent substances:

red fluorescent substance $(Y_xGd_{1-x})\ BO_3:Eu^{3+}$ green fluorescent substance $Zn_2SiO_4:Mn$ blue fluorescent substance $BaMgAl_{10}O_{17}:Eu^{2+}$ or $BaMgAl_{14}O_{23}:Eu^{2+}$ Producing PDP by Bonding Together Front Panel 10 and Back Panel 20

A PDP is made by bonding together the front panel 10 and the back panel 20, which are produced as described above, with a sealing glass, at the same time excluding the air from the discharge spaces between the partition walls 24 to high vacuum ($8\times10^{-7}$ Torr) , then charging a discharge gas with a certain composition into the discharge spaces 30 at a certain charging pressure.

In the present embodiment, the pitch of the partition walls 24 is set to 0.2 mm or less and distance between the discharge electrodes 12 is set to 0.1 mm or less, making the cell size of the PDP conform to 40-inch high-vision TVs.

The discharge gas is composed of He—Xe gas which has been used conventionally. However, the amount of Xe is set to 5% by volume or more and the charging pressure to the range from 500 to 760 Torr to improve brightness of cells.

The PDP constructed as described above has the dielectric glass layer 13 whose thickness is thin so that the discharge voltage decreases and the load on each component of the panel during the operation is reduced.

Each electrode (the display electrodes 12 and the address electrodes 22) is covered finely with the dielectric glass layers 13 or 23 via the metallic oxide layers 13*a* or 23*a*, with there being a significant reduction in bubbles in the dielectric glass layers 13 and 23.

As a result, the withstand voltage is increased even if the dielectric glass layer 13 is formed as a thin layer. Therefore the initial high performance, such as high Panel brightness and low discharge voltage, can be maintained after long-term and repeated use and a reliable PDP with a thin dielectric glass layer can be produced.

In the present embodiment, the metallic oxide layer is formed on both of the front panel 10 and the back panel 20 and the dielectric glass layer is formed on the metallic oxide layer. However, it is possible to apply the metallic oxide layer only to one of the front panel 10 and the back panel 20. In the case of a PDP without dielectric glass layer on the back panel 20, it is possible to apply the metallic oxide layer only to the front panel 10.

It is difficult to form a thin dielectric glass layer on silver electrodes so that there is a great effect by forming the metallic oxide layer on the silver electrodes with the CVD method. Therefore, the present embodiment describes the case where the discharge electrodes 12 and the address electrodes 22 are silver electrodes. However, this embodiment can be applied to other electrodes, such as Cr—Cu—Cr electrodes.

In the present embodiment, one whole side of each of the glass substrates 11 and 21 is coated with the metallic oxide layers 13*a* and 23*a*, respectively. However, coating only the surfaces of the electrodes 12 and 22 has the same effect.

{Embodiment 2}

The PDP of the present embodiment is the same as that of Embodiment 1 except that the dielectric glass layers 13 and 23 are not provided and the metallic oxide layers 13*a* and 23*a* double as the dielectric layer.

As stated above, in this PDP, the metallic oxide layers 13*a* and 23*a* function as the dielectric layer. However, if the metallic oxide layers 13*a* and 23*a* are too thin, the layers 13*a* and 23*a* cannot function as the dielectric layer, so that the thickness of the layers 13*a* and 23*a* is set to a range of 3 μm to 50 μm, preferably to a range of 3 μm. to 6 μm.

The metallic oxide layer can be formed, for instance, of bismuth oxide, cesium oxide, or antimony oxide, in addition to the metallic oxides described in Embodiment 1, which are zirconium oxide, zinc oxide, titanium oxide, aluminium oxide, silicon oxide, magnesium oxide, and chromium oxide.

As the discharge electrodes and the address electrodes, in addition to silver electrodes and Cr—Cu—Cr electrodes described above, metallic electrodes which are conventionally used in PDPs can be used.

When the dielectric layer is made of metallic oxide with the CVD method, as the present embodiment, a dense and even layer can be formed on electrode surfaces which include projections and depressions.

With this method, even if the dielectric layer is formed to have a thickness ranging from 3 μm to 6 μm, which is considerably thinner than a conventional layer (20 μm to 30 μm), a flawless dielectric layer is formed, preventing the dielectric breakdown.

When the dielectric layer is formed by applying and baking a material of the dielectric layer according to the conventional method, a glass including lead oxide is used to prevent the baking temperature from rising too high. However, when the metallic oxide layers 13*a* and 23*a* double as the dielectric layer., as the present embodiment, a dielectric layer not including lead oxide is formed.

The metallic oxide layers 13*a* and 23*a* are formed with the CVD method which is the vacuum process method, so that the dielectric layer can be formed without a step of baking. Therefore, even if a thin glass substrate is used, warping and cracks in the dielectric layer due to thermal distortion is reduced during baking.

It is also possible to form a magnesium oxide protecting layer on the surface of the metallic oxide layer which, as described above, is formed with the CVD method and doubles as the dielectric layer. If the metallic oxide layer and the protecting layer are formed successively using the CVD apparatus described in Embodiment 1, a high-quality protecting layer can be formed because the interface surface between the metallic oxide layer and the protecting layer is formed without coming into contact with air.

EXAMPLE 1

PDPs in Table 1 are produced according to Embodiments 1 and 2.

PDP. Example Nos. 1–8, 12, and 14–20 are produced according to Embodiment 1, where the discharge electrodes and the address electrodes are silver electrodes. PDP Example Nos. 9–11, 21, and 22 are produced according to Embodiment 2 and the discharge electrodes and the address electrodes are Cr—Cu—Cr electrodes.

As shown in Table 1, the dielectric glass layers 13 and 23 of PDP Example Nos. 1–8, and 12 are made of glasses based on $PbO—B_2O_3—SiO_2—TiO_2—Al_2O_3$. The dielectric constant ∈ of the glasses varies in a range of 10 to 20 because of the differences in glass composition. The thicknesses of the dielectric glass layers 13 and 23 are set to a range of 5 μm to 14 μm.

The discharge gas is a He—Xe mixture gas including 5% by weight of Xe and the charging pressure is set to 600 Torr.

The dielectric glass layers 13 and 23 of PDP Example Nos. 14–20 are made of glasses based on $Bi_2O_3—ZnO—B_2O_3—SiO_2—CaO—TiO_2$. The dielectric constant of the glasses is set to a range of 12 to 24. The discharge gas is a He—Xe mixture gas including 7% by weight of Xe and the charging pressure is set to 600 Torr.

The following condition is common to all of PDP Example Nos. 1–24.

The following fluorescent substances are used for the fluorescent substance layers: $BaMgAl_{10}O_{17}:Eu^{2+}$ is used as blue fluorescent substance, $Zn_2SiO_4$:Mn as green fluorescent substance; $(Y_xGd_{1-x})\ BO_3:Eu^{3+}$ as red fluorescent substance, where the average particle diameter of these substances is 2.0 μm.

The cell size of PDPs is set as follows to conform to 42-inch high-vision TVs, the height of the partition walls 24 is 0.15 mm, the distance between the partition walls 24 (cell pitch) 0.15 mm, and the distance between the discharge electrodes 12 0.05 mm.

The MgO protecting layer 14 is formed with the plasma CVD method using magnesium acetylacetone ($Mg(C_5H_7O_2)_2$).

The plasma CVD method is performed under the condition that the temperature of the bubblers is 125° C. and the heating temperature of the glass substrate 47 is 250° C. Ar gas and oxygen are sent onto the glass substrate 47 for one minute at the flow rates of 1 l/min and 2 l/min, respectively. The pressure in the CVD apparatus is reduced to 10 Torr, and the high-frequency electric field of 13.56 MHz is applied at 300 W for 20 seconds.

The Mgo protecting layer 14 is formed at a rate of 0.1 μm/min to have a thickness of 1.0 μm.

With the X-ray analysis of crystal orientation of the MgO protecting layer formed as described above, it is confirmed that each Example has (100)-face orientation.

Examples for Comparison 1

PDP Example Nos. 13 and 24 are examples for comparison and are made in the same way as PDP Example Nos. 12 and 23 except that the electrodes are not coated with the metallic oxide layer.

EXPERIMENTS

Experiment 1

PDP Example Nos. 1–24 produced as described above are discharged on a discharge maintenance voltage of about 150V with a frequency of about 30 KHz and the panel brightness (the initial value) is measured. The experimental results are given in Table 1.

Experiment 2

Twenty PDPs are produced for each of Example Nos. 1–24 and subjected to the accelerated life test.

In the accelerated life test, each of the PDPs is discharged continuously for 4 hours under harsher conditions than those encountered during ordinary use, on a discharge maintenance voltage of 200V with a frequency of 50 KHz . After the discharge, the dielectric glass layer and other parts in the panel are examined to check the state of the panel, such as the problems whit the withstand voltage of the panel, and the number of faulty panels is counted out of the twenty PDPs. The experimental results are also given in Table 1.

Examination

While a conventional PDP has a panel brightness of 400 cd/m$^2$ (see Nikkei Electronics Vol. 5-5, 1997, P106), the experimental results of PDP Examples 1–24 in Table 1 indicate outstanding panel brightness.

This is because the dielectric glass layer is thin and the charging pressure of the discharge gas is high, in comparison with the conventional PDP.

The panel brightness of the PDP Example 13 is lower than other PDP Examples. This may be because the thickness of the dielectric layer of PDP Example 13 is 20 $\mu$m, whereas the thicknesses of the dielectric layers of the other PDP Examples are 15 $\mu$m or less.

It is apparent from the result of the accelerated life test that PDP Examples 1–12 and 14–23 have outstanding withstand voltage though their dielectric glass layers are thinner than PDP Examples 13 and 24.

These results show that by coating the electrodes with the metallic oxide using the CVD method, the thickness of the dielectric glass layer can be set to 15 $\mu$m or less which is thinner than a convention layer, so that it is possible to improve the panel brightness and the withstand voltage.

{Embodiment 3}

Figure 7A:
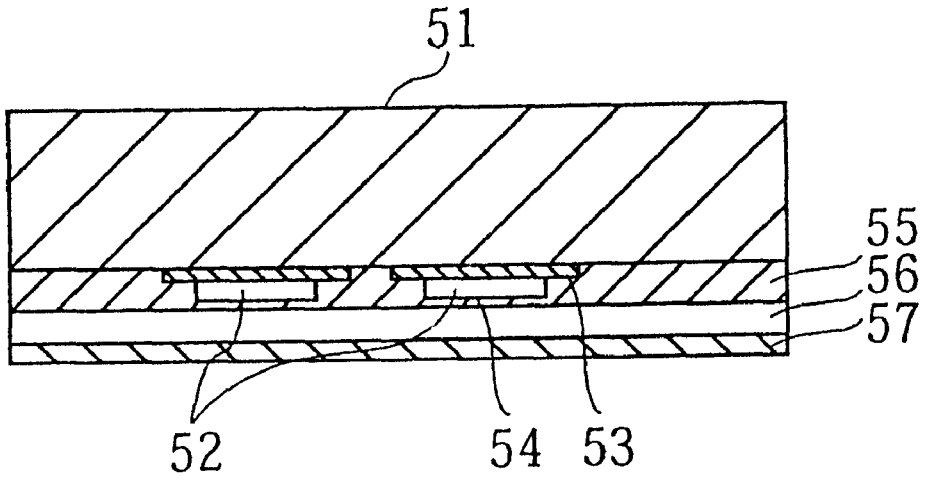
FIGS. 7A and 7B are sectional views of a front panel of the PDP of Embodiment 3.
Figure 7B:
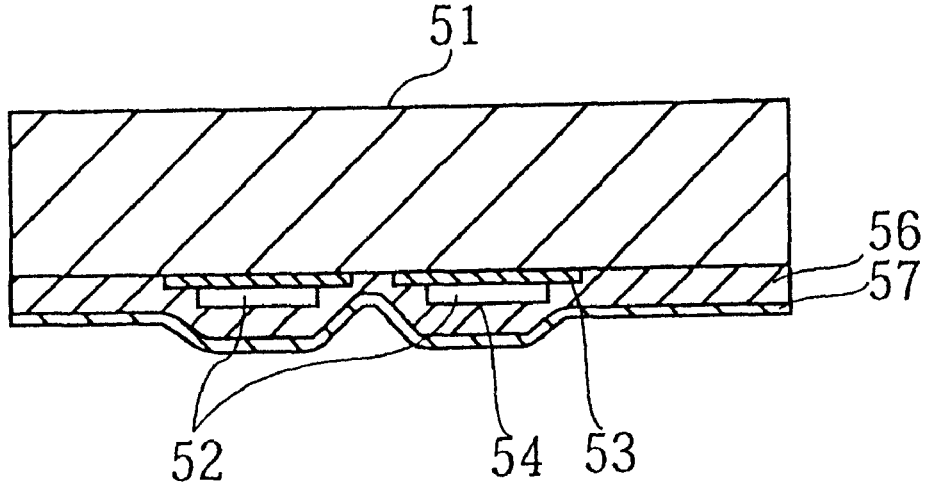

FIGS. 7A and 7B are sectional views of the front panel of the PDP of the present embodiment.

In FIG. 7A, the element 51 is a front glass substrate, the elements 52 display electrodes, and each of the display electrodes 52 is composed of the transparent electrode 53 and the metallic electrode 54. The metallic electrode 54 has a narrower width than the transparent electrode 53 and is placed on the top of transparent electrode 53. The element 55 is a lower dielectric layer, the element 56 an upper dielectric layer, and the element 57 a protecting layer. The display electrodes 52 are coated with the dielectric layers 55 which is further coated with dielectric layer 56.

Although FIG. 7A does not show the back panel, the PDP of the present embodiment includes a conventional back panel which is a back panel that has address electrodes, partition walls, and fluorescent substance layers on its back glass substrate. The PDP is constructed by bonding together the front panel and the back panel, and charging a discharge gas (neon 95% and xenon 5%) into discharge spaces formed between the front and back panels.

The front panel in FIG. 7A is produced as follows: the transparent electrodes 53 are formed on the glass substrate 51 using a metallic oxide material, such as tin oxide and indium tin oxide (ITO); the metallic electrodes 54 are formed on the transparent electrodes 53 by printing Ag material on the transparent electrodes 53 or by depositing Cr, Cu, and Cr, in that order, onto the transparent electrodes 53; and the lower dielectric layer 55, the upper dielectric layer 56, and the protecting layer 57 are formed on the metallic electrodes 54 in that order.

The lower dielectric layer 55 is formed by applying and baking flint glass (lead glass).

The upper dielectric layer 56 is made of a metallic oxide such as zirconium oxide, titanium oxide, zinc oxide, bismuth oxide, cesium oxide, and antimony oxide, with the vacuum process method, such as the EB evaporation, sputtering, or CVD method.

The following description explains a case where a titanium oxide layer is formed as the lower dielectric layer 55 with the CVD method described in Embodiment 1, using titanium chelate as the source material, considering safety, material cost, and reactivity with a substrate.

A magnesium oxide layer is also formed as the protecting layer 57 with the CVD method.

The dielectric layer 56 and protecting layer 57 are formed successively with the CVD method. More specifically, the front glass substrate 51 with the display electrodes 52 is placed in the CVD apparatus and the dielectric layer 56 and then the protecting layer 57 are formed on the display electrodes 52.

The dielectric layer 56 and the protecting layer 57 are formed successively with the CVD method so that the mixing of dust in air into the layers and adsorption of oils and fats and nitrogen on the surface of the dielectric layer 56 are prevented. As a result, the interface surface between the dielectric layer 56 and the protecting layer 57 is finely bonded and a fine coat, which is resilient against peels and cracks, can be obtained.

As shown in FIG. 7B, the above PDP can be produced by forming the dielectric layer 56 with a thickness of several $\mu$m on the metallic electrodes 54 with the vacuum process method (the CVD method) without the lower dielectric layer 55. The PDP in this case has the same structure as that of Embodiment 2.

By forming the dielectric layers with the vacuum process method as described above, various materials having a high refractive index and a good spectral transmittance can be used in comparison with the case where the dielectric layers are formed in air.

For instance, when the thickness of the magnesium oxide protecting layer 57 is set to 500 nm and the upper dielectric layer 56 is made of one of aluminium oxide, silicon oxide, and magnesium oxide, with a thickness of 5 $\mu$m or more, the spectral transmittance of the front panel can be improved to 90% or more.

{Embodiment 4}

Figure 8A:
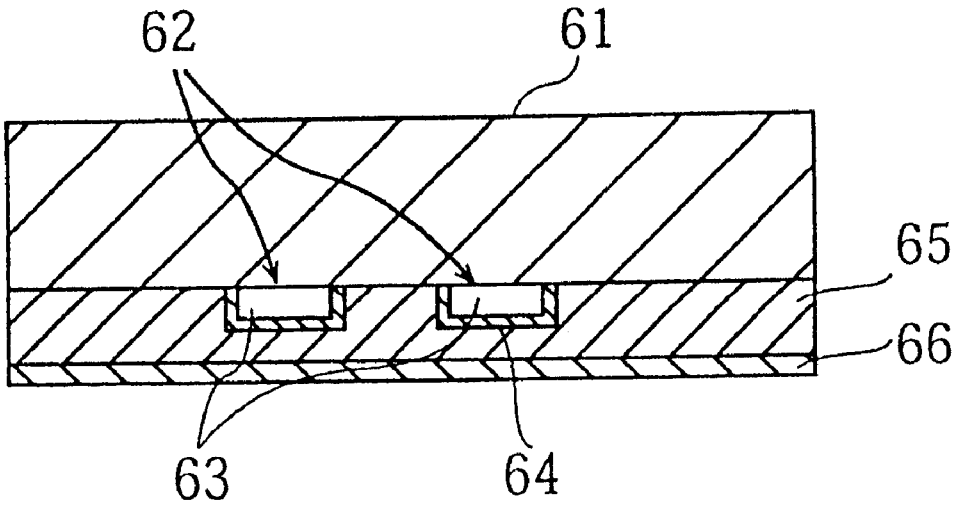
FIGS. 8A and 8B are sectional views of a front panel of the PDP of Embodiment 4.
Figure 8B:
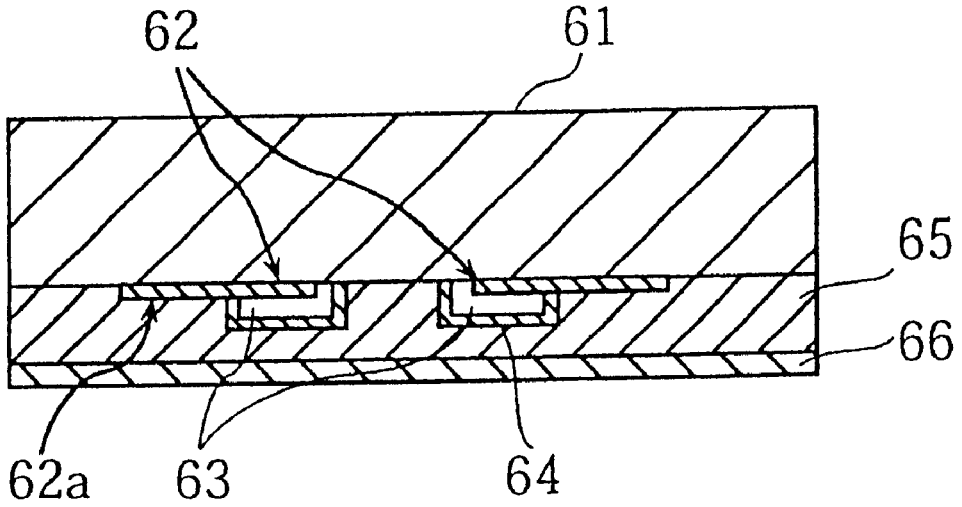

FIGS. 8A and 8B are sectional views of the front panel of the PDP of the present embodiment. As is the case with FIGS. 7A and 7B, the back panel is not shown in FIGS. 8A and 8B. In the drawings, the element 61 is a glass substrate, the elements 62 display electrodes, the element 65 a dielectric layer of flint glass, and the element 66 a MgO Protecting layer.

With the front panel in FIG. 8A, the display electrodes 62 have a structure where the oxide coat 64 is formed on the surface of the metallic electrode 63, and these display electrodes 62 are coated with the dielectric layer 65.

The front panel having the structure shown in FIG. 8A is produced by forming, on the glass substrate 61, the metallic electrodes 63 using such a metal as forms an oxide coat on its surface, then oxidizing the metallic electrodes 63 to form an oxide coat 64 on the surface of the metallic electrodes 63, and printing and baking flint glass on the oxide coat 64 to form the dielectric layer Here, if the metallic electrodes 63 are made of aluminium or tantalum and are subjected to the oxidation treatment with the anodic oxidation method which uses the metallic electrodes 63 as an anode, the oxide coat 64 can be formed as a dense coat.

Tantalum has a high specific resistance so that when tantalum metallic electrodes are formed for a large-screen display, a metal having a high conductivity such as copper should be provided between tantalum metallic electrodes to form a three-phase structure. The electrodes having the three-phase structure, tantalum-copper-tantalum, can be produced by forming a tantalum layer, a copper layer, and a tantalum layer in order with the sputtering method, then removing the layers, with etching, except the parts to be electrodes.

The display electrodes 62 of the front panel shown in FIG. 8B includes the transparent electrodes 62*a* and the metallic electrodes 63. The surface of the metallic electrodes 63 is coated with the oxide coat 64 and the oxide coat 64 is coated with the dielectric layer 65. The metallic electrodes 63 are formed on the transparent electrodes 62*a* to cover one half of the transparent electrode 62*a*.

The front panel having the structure shown in FIG. 8B is produced by forming the transparent electrodes 62*a* using a metal oxide such as tin oxide or ITO (Indium Tin Oxide) on the glass substrate 61, then forming the metallic electrodes 63 on the transparent electrodes 62*a* using aluminium or tantalum as the electric material, then subjecting the metallic electrodes 63 to the oxidization treatment to form the oxide coat 64 on the surface of the metallic electrodes 63, and forming the dielectric layer 65.

With the front panels shown in FIGS. 8A and 8B, the surfaces of the metallic electrodes 63 are coated with dense oxide coat 64 so that the dielectric layers 65 have a good wettability and the faults due to bubbles and the like are reduced. Therefore, even if the dielectric layer 65 is formed as a thin layer, dielectric breakdown can be prevented. That is, as a high withstand voltage is achieved, defects due to withstand voltage failure are reduced.

The PDP of the present embodiment has a protecting layer on a dielectric layer, although it is possible to form, with the vacuum process method, a magnesium oxide layer as a layer functioning as both the dielectric layer and the protecting layer. It is Preferable to set the thickness of such a magnesium oxide layer to a range of 3$\mu$ to 5 $\mu$m.

{Embodiment 5}

Overall Structure of PDP and the Production Method

Figure 9A:
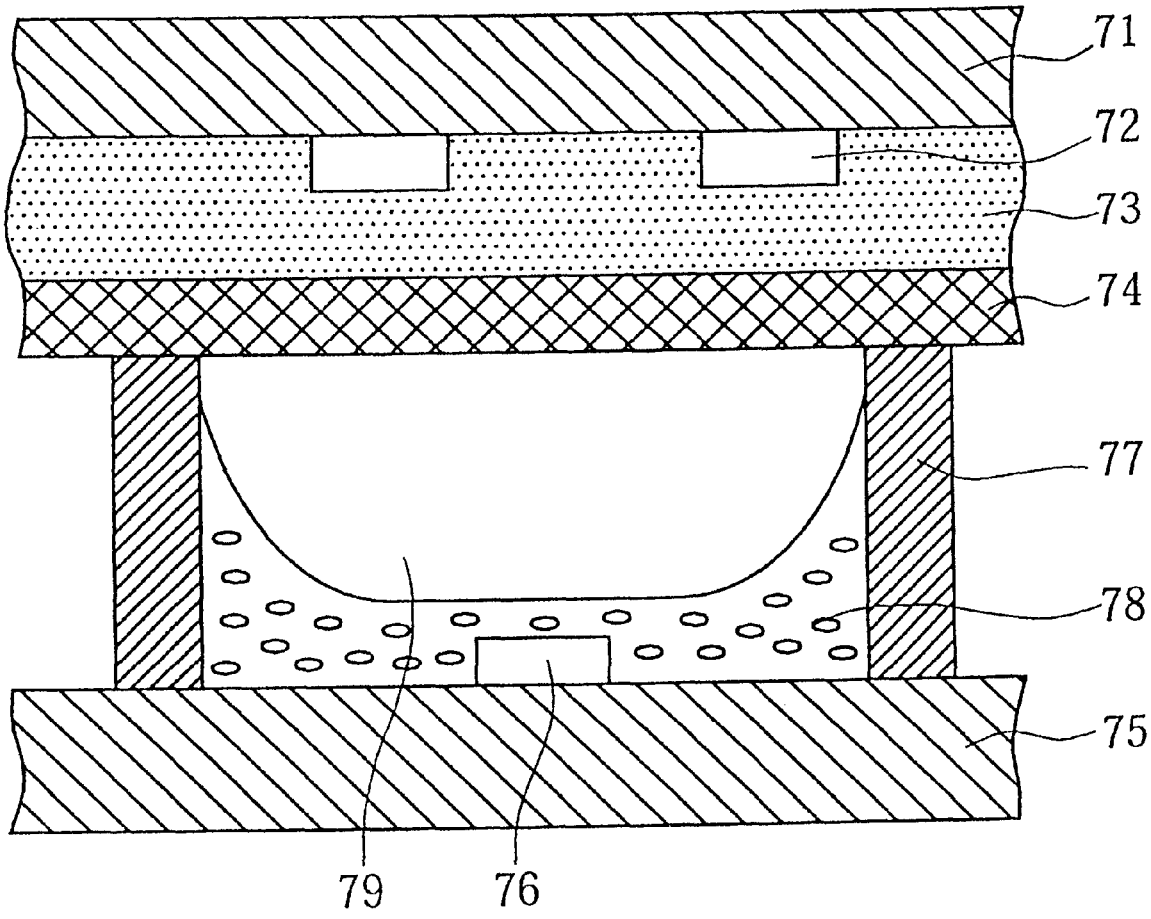
FIGS. 9A and 9B are simplified sectional views of a PDP of Embodiment 5.

FIG. 9A is a sectional view of the AC PDP of the present embodiment. Although FIG. 9A shows only one cell, the PDP includes a number of cells which each emit red, green, or blue light.

Note that, although the dielectric layer is also Provided on the back panel in Embodiment 1, the dielectric layer is not provided on the back panel in the present embodiment.

The PDP of the present embodiment is produced by bonding together a front panel and a back panel to form discharge spaces 79 between these plates in which a discharge gas is charged. The front panel is produced by providing the discharge electrodes (display electrodes) 72 and the dielectric layer 73 on the front glass substrate 71 which is made of borosilicate glass including a small amount of alkali, or 6.5% or less by weight of alkali. The back panel is produced by providing the address electrodes 76, the partition walls 77, and the fluorescent substance layers 78 on the back glass substrate 75 which is made of the same borosilicate glass as the front panel.

The borosilicate glass including a small amount of alkali has a high distortion point (520° C. to 670° C.) and low thermal expansion coefficient ($45\times10^{-7}$/° C. to $51\times10^{-7}$/° C.) and is used for LCDs . For instance, some LCDs use such borosilicate glasses which are about 550 mm×650 mm in area and about 1.1 mm–0.7 mm in thickness (see New Ceramics No. 3, 1995, and Electronic Ceramics, 26(126), 1995, P1–10, for instance).

As described above, using a borosilicate glass including a small amount of alkali as a glass substrate decreases the warping due to the thermal distortion of the glass substrate during the PDP production, even if the thickness of the glass substrate is 2 mm or less, which is thinner than conventional PDPs.

The following is a description of the production method of this PDP.

Producing the Front Panel

The front panel is produced by forming the discharge electrodes 72 on the front glass substrate 71, then forming the dielectric layer 73 with the CVD method or the plasma thermal spraying method to coat the front glass 71 and the discharge electrodes 72, and forming the protecting layer 74 on the surface of the dielectric layer 73.

The discharge electrodes 72 are silver electrodes and are formed by screen printing and baking a silver electrode paste.

When the CVD method is adopted, the dielectric layer 73 made of $Al_2O_3$ or $SiO_2$ is formed with the thermal CVD or the plasma CVD method described in Embodiment 1.

When the dielectric layer 73 is formed with the plasma thermal spraying method, a lead glass layer or a phosphoric acid glass layer is formed. The description of this case is provided in detail late.

As the protecting layer 74, a magnesium oxide layer having a dense crystal structure with (100)-face or (110)-face orientation is formed with the CVD method, as in the case of Embodiment 1.

As described above, the temperature of the glass substrate can be kept relatively low, at 350° C. or less, while a dielectric layer is formed with the CVD or plasma thermal spraying method. That is, the glass substrate is not heated to a high temperature such as 500° C. or more, which is the case when the glass material is printed and baked, so that damage to the glass substrate, such as warping, due to thermal distortion is prevented.

Producing the Back Panel

The address electrodes 76 are formed by screen printing and baking a paste for silver electrodes on the back glass substrate 75.

The partition walls 77 are then formed. In the present embodiment, as described later, the partition walls 77 are formed with the plasma thermal spraying method.

The fluorescent substance layer 78 is formed by transferring the fluorescent substance of each color onto each space surrounded by the partition walls 77.

Producing the PDP by Bonding the Panels

As is the case of Embodiment 1, the PDP is formed by bonding together the front and back panels to form the discharge spaces 79, then evacuating the discharge spaces 79 to produce a high vacuum, and charging a discharge gas into the discharge spaces 79 at a predetermined pressure.

In the present embodiment, Ne—Xe gas is used as the discharge gas.

Figure 10:
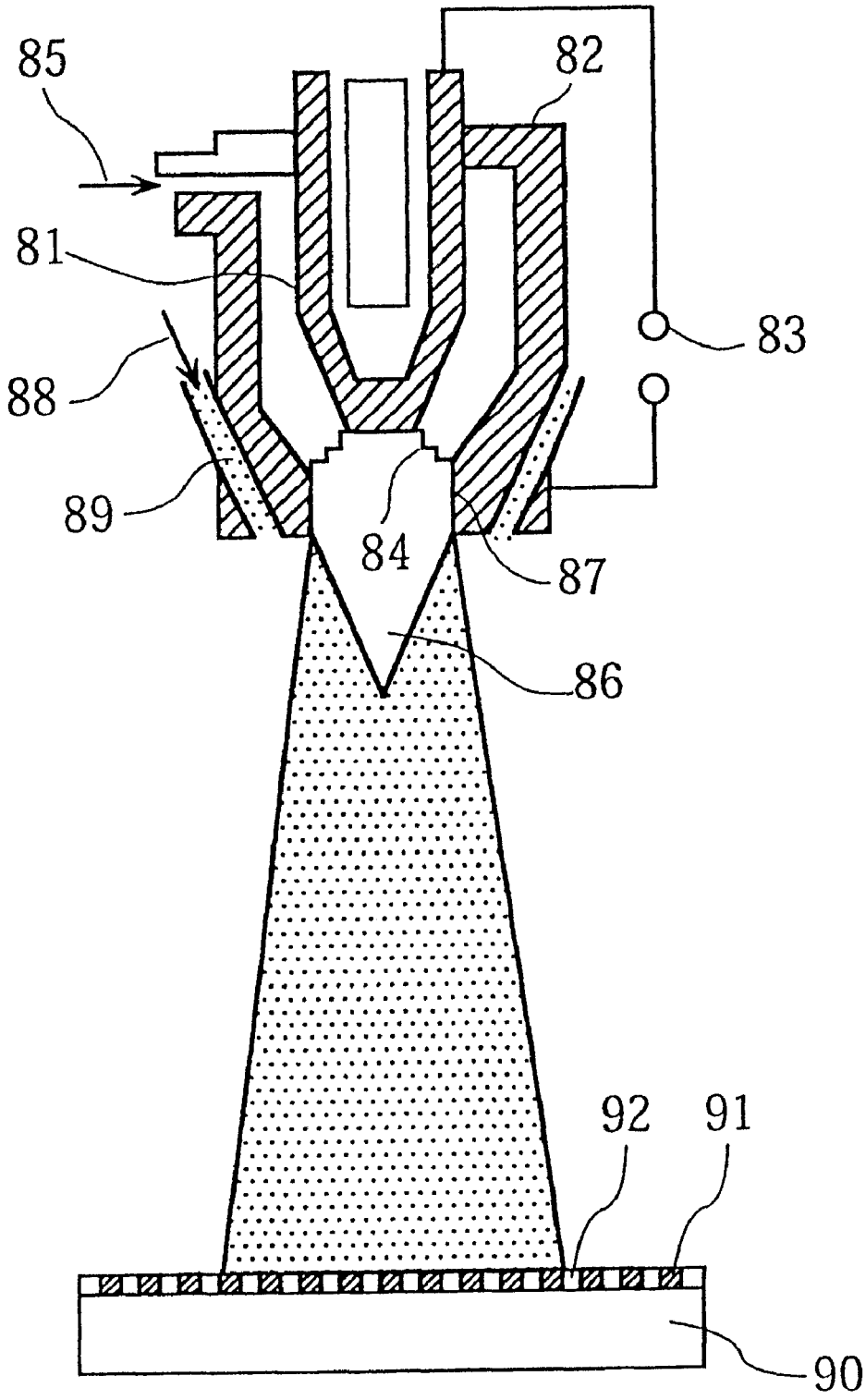
FIG. 10 is a simplified drawing of a plasma thermal spraying apparatus used for forming a dielectric layer and partition walls of Embodiment 5.

Producing the Dielectric Glass Layer and the Partition Walls with the Plasma Thermal Spraying Method FIG. 10 is a simplified drawing of the plasma thermal spraying apparatus used to form the dielectric layer and the partition walls of the PDP of the present embodiment.

In FIG. 10 which shows the plasma thermal spraying apparatus, the element 81 is a cathode, the element 82 an anode, the element 83 a power source, the element 84 d.c.arc, the element 85 orifice gas, the element 86 arc Plasma jet, the element 87 a nozzle, the element 88 a dielectric or partition wall material which is subjected to the plasma spraying, and the element 89 a dielectric material supplying port.

FIG. 10 shows a case where the partition walls are formed by performing the plasma thermal spraying method, with the dry film 91 being placed on the glass substrate 90 which includes electrodes. However, when the dielectric layer is formed, the dry film 91 is not used and the plasma thermal spraying method is performed on the whole surface of the glass substrate having the electrodes. When the dielectric layer is formed using the plasma thermal spraying apparatus described above, the glass substrate having the discharge electrodes thereon is placed in the plasma thermal spraying apparatus and the pressure in the apparatus is reduced to 0.2 Torr.

The d.c.arc 84 is produced, with the electric field being applied between the cathode 81 and the anode 82 using the power source 83. At the same time, the orifice gas 85, or Ar gas, is sent to produce arc plasma jet.

The dielectric material 88 is supplied from the powder supplying port 89 and the thermal spraying nozzle 87 moves across the glass substrate to form the dielectric layer.

Powder of lead glass or phosphoric acid glass is used as the dielectric material 88, the powder having the thermal expansion coefficient in a range of $45\times10^{-7}/°$ C. to $50\times10^{-7}/°$ C. and a softening point of 700° C. to 720° C.

The following is a description of the production of the partition walls using the plasma thermal spraying apparatus described above.

As shown in FIG. 10, the dry film 91 having the openings 92 at the places where the partition walls are to be produced is placed on the glass substrate 90 having the electrodes thereon, the dry film 91 being a photosensitive dry film or other mask having openings as described above. The dry film 91 and the glass substrate 90 are placed in the plasma thermal spraying apparatus and arc plasma jet is generated as is the case of the production of the dielectric layer.

The partition wall material 88 is supplied from the Powder supplying port 89 and the thermal spraying nozzle 87 moves along the openings 92 on the glass substrate to form the partition walls. The dry film 91 or a mask is then removed.

Aluminium oxide ($Al_2O_3$) or mullite ($3Al_2O_3.2SiO_2$) is used as the partition wall material 88.

While the present embodiment describes a case where the partition walls 77 and address electrodes 76 are formed in parallel to each other, it is also possible to form the partition walls 77 and the address electrodes 76 perpendicular to each other with the plasma thermal spraying method.

The back panel of the present embodiment is not provided with the dielectric layer, although the back panel can also be provided with the dielectric layer, like Embodiment 2. When the back panel is also provided with a dielectric layer, both the dielectric layer and the partition walls can be formed without baking so that warping will not often be caused even if a thin back glass substrate is used.

Figure 9B:
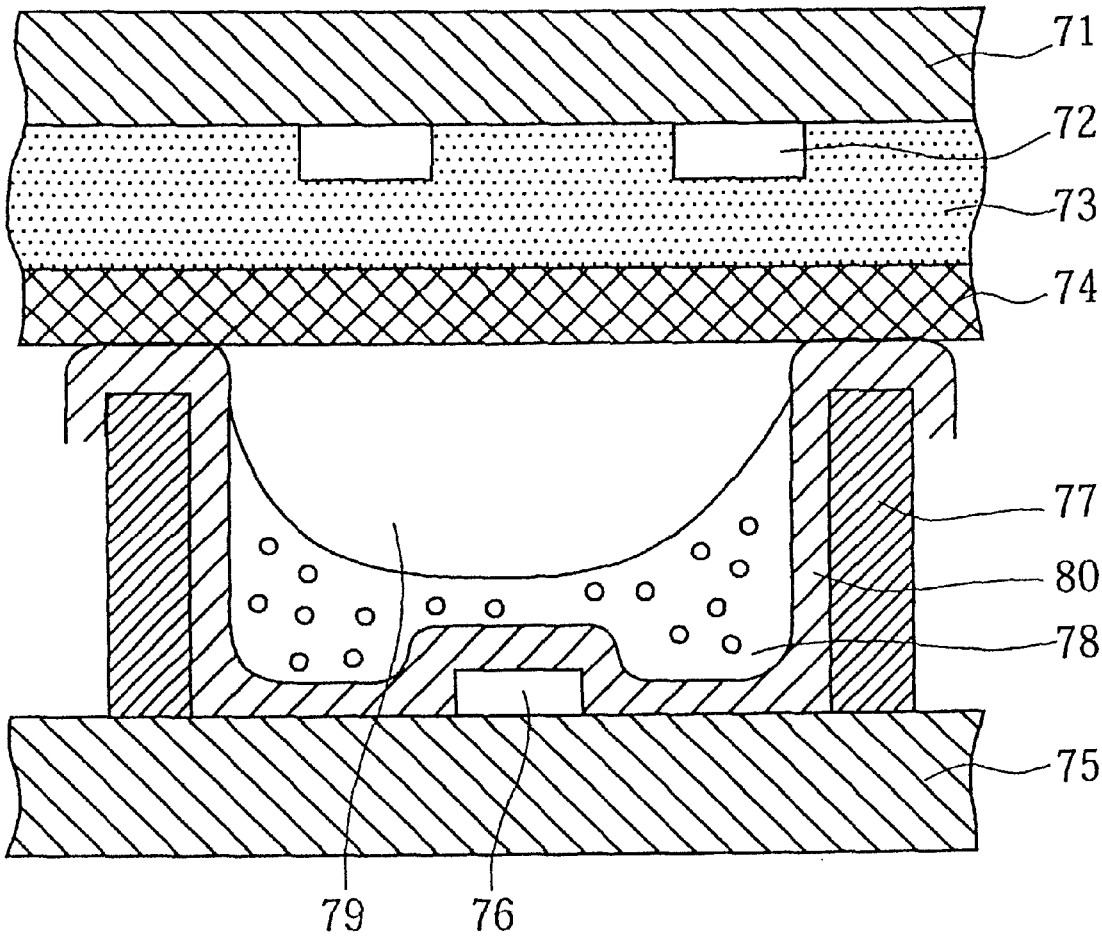

When, during the production of the back panel, the dielectric layer 80 is formed with the CVD or plasma thermal spraying method after the partition walls are formed with the plasma thermal spraying method, the panel can also have such a structure where the dielectric layer 80 coats the whole surfaces of the partition walls, as shown in FIG. 9B.

The partition walls are formed with the plasma thermal spraying method tend to be porous, in comparison with the partition walls formed with a conventional production method. With such porous partition walls, the PDP may deteriorate due to out-gas from the partition walls to the discharge space. This out-gas can be prevented, however, if the whole surfaces of the partition walls are coated with the dielectric layer as shown in FIG. 9B.

Comparison of the Present Embodiment and the Conventional Method in Terms of the Effect When a conventional method is used and the dielectric layer is formed by printing lead glass whose thermal expansion coefficient is in a range of $80\times10^{-7}/°$ C. to $83\times10^{-7}/°$ C. and baking at 500–600° C., cracks tend to occur to the dielectric layer by thermal distortion due to different thermal expansion coefficients of the materials. Cracks also tends to occur to the partition walls due to thermal distortion when they are formed by applying and baking a glass material with a conventional method.

Even if a glass having a small thermal expansion coefficient is used as a material of the dielectric layer and partition walls, cracks and warping tend to occur to the dielectric layer and the partition walls during baking. This is because such glass has a high softening point. For instance, the softening point of a glass, whose thermal expansion coefficient is $50\times10^{-7}/°$ C. or less, is 700° C. or more.

On the contrary, as in the case of the present embodiment, baking which is necessary for the conventional printing method is not required for the method in which the dielectric layer is formed with the CVD and plasma spraying method, and the partition walls are formed with the plasma spraying method. Therefore, the glass substrate, the dielectric layer, and the partition walls are not heated to a high temperature, such as to 500° C. or more, during the production of a PDP so that the thermal distortion in the glass substrate, the dielectric layer, and the partition walls is extremely reduced. As a result, even if the glass substrate is thin, warping of the glass substrate and cracks in the dielectric layer and the partition walls can be prevented.

Using a borosilicate glass including a small amount of alkali as the glass substrate, which has smaller thermal expansion coefficient than conventional soda lime glass, prevents more effectively the warping of the glass substrate and the formation of cracks in the dielectric layer and the partition walls.

This method does not consume a large amount of energy in a kiln, and so also contributing to energy saving.

EXAMPLE 2

Example PDP Nos. 25–32 shown in Tables 2 and 3 are formed according to Embodiment 5. Table 2 shows the characteristics of the glass substrate of each PDP and Table 3 shows the conditions for Producing the dielectric layer, the protecting layer, and the partition walls, and their experimental data.

As shown in Table 2, Example PDP Nos. 25 and 26 use OA-2 not including alkali (where OA-2 is the product name of Nihon Electric Glass co.), Nos. 27 and 28 use BLC including 6.5% by weight of alkali (where BLC is the product name of Nihon Electric Glass co.), Nos. 29 and use NA45 not including alkali (where NA45 is the product name of NH Techno Glass co.), Nos. 31 and 32 use NA35 not including alkali (where NA35 is the product name of NH Techno Glass co.).

The thickness of each glass substrate is set in a range of 0.1 mm to 1.5 mm, as shown in Table 2.

Producing the Dielectric Layer

The thickness of each dielectric layer is set to 20 $\mu$m.

The dielectric layers of Nos. 25, 27, 28, and are formed with the plasma thermal spraying method.

For No. 25, argon (Ar) is used as the orifice gas and glass powder including PbO(30)—$B_2O_3$(20)—$SiO_2$(45)—$Al_2O_3$ (5), whose softening point is 720° C. and thermal expansion coefficient $45\times10^{-7}/°$ C., is used as the dielectric material. The condition for forming the dielectric layers is that plasma jet is generated with 5 KW of electric power and the plasma spraying is performed for 10 minutes.

The dielectric layer of No. 27 is formed under the above condition except that glass powder including $P_2O_5$(45)—

ZnO(34)—$Al_{2l\ O3}$(18)—CaO(3), whose softening point is 700° C. and thermal expansion coefficient $50\times10^{-7}$/° C. is used as a material of the dielectric layer. The dielectric layers of Nos. 28 and are formed under the same condition as that for Nos. 25 and 27 except for composition of the glass material.

The dielectric layer of No. 26 is formed with the thermal CVD method. Aluminium dipivaloyl methane ($Al(C_{11}H_{19}O_2)_3$) is used as a source material of the dielectric layer and the temperature of the bubbler is set to 125° C. and the heating temperature of the glass substrate to 250° C.

The dielectric layer made of $Al_2O_3$ is formed under the condition that Ar gas and oxygen are sent at a rate of 1 l/min and 2 l/min, respectively, for 20 minutes and the coat forming ratio is adjusted to 1.0 μm/min.

The dielectric layers of Nos. 28, 31, and 32 are formed with the plasma CVD method. The dielectric layers of Nos. 28, 31, and 32, being made of $Al_2O_3$, $SiO_2$, or $3Al_2O_3.2SiO_2$, are formed under the condition that aluminium acetylacetone ($Al(C_5H_7O_2)_3$) or TEOS is used as a source material, the glass substrate is heated to 250° C., the pressure in the reactor is reduced to 10 Torr, and a high-frequency electrical field of 13.56 MHz is applied.

Producing the Protecting Layer

The thickness of each protecting layer is set to 1 μm.

The protecting layers of Nos. 25 and 26 are formed with the thermal CVD method under the condition that cyclopentadienyl magnesium acetylacetone $Mg(C_5H_5)_2$ is used as the source material, the temperature of the bubbler 23 is set to 100° C., the heating temperature of the glass substrate 27 is set to 250° C., and Ar gas and oxygen are sent at a rate of 1 l/min and 2 l/min, respectively, for one minute.

The protecting layers of Nos. 27–32 are formed with the plasma CVD method under the condition that $Mg(C_5H_5)_2$ is used as the source material for the plasma CVD method, the heating temperature of the glass substrate is set to 250° C., the pressure in the CVD apparatus is reduced to 10 Torr, and a high-frequency electrical field of 13.56 MHz is applied.

Producing the Partition Walls

The partition walls are formed with the plasma thermal spraying method under the condition that the substrate is masked with a dry film, argon gas (Ar) is used as an orifice gas, plasma jet is generated with 5 KW of electric power, and the partition wall material is subjected to the plasma spraying for 10 minutes. The height of the partition walls is set to 0.12 mm and the distance between the partition walls (cell pitch) to 0.15 mm, to conform to a 42-inch display for high-vision TV.

The partition walls of Nos. 25 and 26 are made of aluminium oxide ($Al_2O_3$) having an average particle diameter of 5 μm.

The partition walls of Nos. 27–32 are made of mullite ($3Al_2O_3.2SiO_2$) having an average particle diameter of 5 μm.

The following are other conditions which are common to Nos. 25–32.

The size of the glass substrate is set to 97×57 cm in area which is necessary to produce a 42-inch panel.

The following fluorescent substances are used for the fluorescent substance layers: $BaMgAl_{10}O_{17}:Eu^{2+}$ is used as blue fluorescent substance, $Zn_2SiO_4$:Mn as green fluorescent substance; $(Y_xGd_{1-x})\ BO_3:Eu^{3+}$ as red fluorescent substance, where the average particle diameter of these substances is 2.0 μm.

Each fluorescent substance is mixed with α-terpineol which includes 10% ethyl cellulose using a three-roll mill to produce a paste used for screen printing. The paste is printed in the areas between the partition walls with the screen printing method and is baked at 500° C. to form fluorescent substance layers.

Neon (Ne) gas including 5% Xe gas is used as a discharge gas and is charged at a charging pressure of 600 Torr.

The PDPs constructed as described above are discharged on a discharge maintenance voltage of 200V with a frequency of 30 KHz to measure the wavelength of ultraviolet rays. Resonance lines of Xe molecular with a wavelength of 173 nm are mainly observed.

Example for Comparison 2

The PDP of No. 33 has the same structure as that of No. 25 except that the glass substrate is made of a soda lime glass and is 2.7 mm in thickness.

The PDP of No.34 has the same structure as No. 26 except that the glass substrate is made of a soda lime glass and is 1.5 mm in thickness.

The PDP of No. 35 has the same structure as No. 27 except that the glass substrate is a high-distortion-point glass for PDP (PD-200) and is 2.7 mm in thickness.

The PDP of No. 36 has the same structure as No. 31 except that the glass substrate is a high-distortion-point glass for PDP (PD-200) and is 1.5 mm in thickness.

Experiments

The PDPs of Nos. 25–36 were checked to see whether cracks have occurred, as described below.

For aging, the panels were discharged on a discharge maintenance voltage of 200V with a frequency of 30 KMz and the panel brightness was measured. After the panels were discharged for 5000 hours, the changing rate of the panel brightness, namely the changing rate between the initial value and the value after the panels are operated for 5000 hours, is measured.

Table 3 shows the observation and experimental results.

It is apparent from Tables 2 and 3 that the dielectric layers and panels of the PDPs of Nos. 25–32 have not cracked, even though the PDPs have thin glasses and light weight, in comparison with the PDPs of Nos. 33–36. In particular, the PDPs of Nos. 25, 26, and 29–32 use glass substrates made of glasses not including alkali, whose distortion points are 610° C. or more, thus contributing to good results.

This is because the PDFs of Nos. 25–32 use glass substrates including less alkali, whose thermal expansion coefficients are small, so that it is hard for warping to occur during baking even if the substrates are thin. Further, with the CVD or plasma spraying method, the dielectric layers and partition walls are made of materials whose thermal expansion coefficients are similar to the substrates, so that thermal distortion is reduced during the production of the PDPs.

Others

While the whole main surface of the glass substrate is coated with the dielectric layers in Embodiments 1–5, only the vicinity of the electrodes may be coated.

Although Embodiments 1–5 show the case where the partition walls are attached onto the back glass substrates to produce the back panels, the present invention is not limited to such construction. For instance, the present invention can be applied to PDPs whose partition walls are provided on the front panels and to general AC PDPs.

Although Embodiments 1–5 describe AC PDPs, the present invention can be applied to counter-electrode PDPs.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

TABLE 1

| EXAMPLE NUMBER | ELECTRODE MATERIAL | METALLIC OXIDE ON ELECTRODE | COMPOSITION OF DIELECTRIC GLASS LAYER (% BY WEIGHT) PbO | $B_2O_3$ | $SiO_2$ | $Al_2O_3$ | $TiO_2$ | |
|---|---|---|---|---|---|---|---|---|
| 1 | Ag | CVD METHOD ZnO (0.5 μm) | 78 | 11 | 10 | 1 | 0 | |
| 2 | Ag | CVD METHOD $ZrO_2$ (0.1 μm) | 65 | 19 | 12 | 3 | 0 | |
| 3 | Ag | CVD METHOD MgO (0.2 μm) | 73 | 10 | 5 | 2 | 10 | |
| 4 | Ag | CVD METHOD $TiO_2$ (0.5 μm) | 74 | 10 | 5 | 10 | 5 | |
| 5 | Ag | CVD METHOD $SiO_2$ (2.0 μm) | 74 | 10 | 5 | 10 | 5 | |
| 6 | Ag | CVD METHOD $Al_2O_3$ (1.5 μm) | 74 | 10 | 5 | 10 | 5 | |
| 8 | Ag | CVD METHOD $Cr_2O_3$ (1.0 μm) | 74 | 10 | 5 | 10 | 5 | |
| 9 | Cr—Cu—Cr | CVD METHOD $SiO_2$ (5.0 μm) | 0 | 0 | 10 | 0 | 0 | |
| 10 | Cr—Cu—Cr | CVD METHOD $Al_2O_3$ (3.0 μm) | 0 | 0 | 10 | 0 | 0 | |
| 11 | Cr—Cu—Cr | CVD METHOD ZnO (6 μm) | 0 | 0 | 10 | 0 | 0 | |
| 12 | Ag | CVD METHOD $Al_2O_3$ (0.1 μm) $SiO_2$ (0.3 μm) | 74 | 10 | 5 | 10 | 5 | |
| 13 | Ag | NO METALLIC OXIDE | 74 | 10 | 5 | 10 | 5 | |
| 14 | Ag | CVD METHOD ZnO (0.1 μm) | 45 | 23 | 22 | 5 | 5 | 0 |
| 15 | Ag | CVD METHOD $ZrO_2$ (0.3 μm) | 45 | 20 | 20 | 5 | 5 | 5 |
| 16 | Ag | CVD METHOD MgO (0.5 μm) | 30 | 37 | 10 | 3 | 10 | 10 |
| 17 | Ag | CVD METHOD $TiO_2$ (1.0 μm) | 40 | 25 | 23 | 2 | 3 | 7 |
| 18 | Ag | CVD METHOD $SiO_2$ (1.0 μm) | " | " | " | " | " | " |
| 19 | Ag | CVD METHOD $Al_2O_3$ (0.5 μm) | " | " | " | " | " | " |
| 20 | Ag | CVD METHOD $Cr_2O_3$ (0.3 μm) | " | " | " | " | " | " |
| 21 | Cr—Cu—Cr | CVD METHOD ZnO (6 μm) | 0 | 0 | 0 | 0 | 0 | 0 |
| 22 | Cr—Cu—Cr | CVD METHOD $Cr_2O_3$ (5 μm) | 0 | 0 | 0 | 0 | 0 | 0 |
| 23 | Ag | CVD METHOD $SiO_2$ (0.5 μm) $TiO_2$ (0.2 μm) | 40 | 25 | 23 | 2 | 3 | 7 |
| 24* | Ag | NO METALLIC OXIDE | 40 | 25 | 23 | 2 | 3 | 7 |

| EXAMPLE NUMBER | DIELECTRIC CONSTANT ε | THICKNESS OF GLASS | THE NUMBER OF PANELS CAUSING WITH STAND VOLTAGE FAILURE IN 20 PANELS AFTER AGING ON 150 V AND 30 KHZ | PANEL BRIGHTNESS cd/m$^2$ |
|---|---|---|---|---|
| 1 | 10 | 13 μm | 0 | 515 |
| 2 | 11 | 14 μm | 0 | 512 |
| 3 | 20 | 13 μm | 0 | 516 |
| 4 | 13 | 13 μm | 0 | 513 |
| 5 | 13 | 5 μm | 0 | 526 |
| 6 | 13 | 8 μm | 0 | 520 |
| 8 | 13 | 10 μm | 0 | 520 |
| 9 | — | 0 μm | 1 | 535 |
| 10 | — | 0 μm | 1 | 540 |
| 11 | — | 0 μm | 1 | 530 |
| 12 | 13 | 12 μm | 0 | 520 |
| 13 | 13 | 20 μm | 10 | 475 |
| 14 | 12 | 14 μm | 0 | 510 |
| 15 | 18 | 13 μm | 0 | 512 |
| 16 | 24 | 13 μm | 0 | 513 |
| 17 | 20 | 12 μm | 0 | 515 |
| 18 | " | 11 μm | 0 | 515 |
| 19 | " | 12 μm | 0 | 514 |
| 20 | " | 12 μm | 0 | 514 |
| 21 | — | 0 | 1 | 520 |

TABLE 1-continued

| | | | | |
|---|---|---|---|---|
| 22 | — | 0 | 2 | 519 |
| 23 | 20 | 10 μm | 0 | 520 |
| 24* | 20 | 15 μm | 8 | 480 |

*EXAMPLE NUMBER 13 AND 24 FOR COMPARISON

TABLE 2

| | GLASS SUBSTRATE | | | | |
|---|---|---|---|---|---|
| EXAMPLE NUMBER | PRODUCT NAME | MANUFACTURER | DISTORTION POINT (° C.) | SPECIFIC GRAVITY OF GLASS ($g/cm^3$) | THEMAL EXPANSION COEFFICIENT ($\times 10^{-1}$/C.) |
| 25 | OA-2 | NIHON ELECTRIC GLASS CO. | 650 | 2.73 | 47 |
| 26 | OA-2 | NIHON ELECTRIC GLASS CO. | 650 | 2.73 | 47 |
| 27 | BLC | NIHON ELECTRIC GLASS CO. | 535 | 2.36 | 51 |
| 28 | BLC | NIHON ELECTRIC GLASS CO. | 535 | 2.36 | 51 |
| 29 | NA45 | NH TECHNO GLASS CO. | 610 | 2.78 | 46 |
| 30 | NA45 | NH TECHNO GLASS CO. | 610 | 2.78 | 46 |
| 31 | NA-35 | NH TECHNO GLASS CO. | 650 | 2.50 | 39 |
| 32 | NA-35 | NH TECHNO GLASS CO. | 650 | 2.50 | 39 |
| 33* | SODA LIME GLASS (AS) | ASAHI GLASS CO. | 511 | 2.49 | 85 |
| 34* | SODA LIME GLASS (AS) | ASAHI GLASS CO. | 511 | | 85 |
| 35* | PD-200 | ASAHI GLASS CO. | 570 | 2.77 | 84 |
| 36* | PD-200 | ASAHI GLASS CO. | 570 | 2.77 | 84 |

| | GLASS SUBSTRATE | | | | | |
|---|---|---|---|---|---|---|
| EXAMPLE | COMPOSITION OF GLASS (% BY WEIGHT) *RO (MgO, CaO, SrO, BaO) **R2O (Na2O, K2O) | | | | | THICKNESS OF GLASS SUBSTRATE |
| NUMBER | $SiO_2$ | $Al_2O_3$ | $B_2O_3$ | (ALKALINE EARTH) | (ALKALI) | (mm) |
| 25 | 56 | 15 | 2 | 27 | 0 | 1.0 |
| 26 | 56 | 15 | 2 | 27 | 0 | 0.7 |
| 27 | 72 | 5 | 9 | 7.5 | 6.5 | 1.5 |
| 28 | 72 | 5 | 9 | 7.5 | 6.5 | 1.0 |
| 29 | 49 | 11 | 15 | 25 | 0 | 1.0 |
| 30 | 49 | 11 | 15 | 25 | 0 | 0.5 |
| 31 | 56 | 15 | 2 | 27 | 0 | 1.5 |
| 32 | 56 | 15 | 2 | 27 | 0 | 0.1 |
| 33* | 72.5 | 2 | 0 | 12 | 13.5 | 2.7 |
| 34* | 72.5 | 2 | 0 | 12 | 13.5 | 1.5 |
| 35* | 58 | 7 | 0 | 21 | 14 | 2.7 |
| 36* | 58 | 7 | 0 | 21 | 14 | 1.5 |

*EXAMPLE NUMBER 9–12 FOR COMPARISON

TABLE 3

| | DIELECTRIC LAYER | | | |
|---|---|---|---|---|
| EXAMPLE NUMBER | FORMING METHOD | COMPOSITION OF DIELECTRIC LAYER (% BY WEIGHT) | THERMAL EXPANSION COEFFICIENT ($\times 10^{-7}$/° C.) | PROTECTING LAYER (FORMING METHOD AND FACE ORIENTATION) |
| 25 | THERMAL SPRAYING METHOD | PbO (30), $B_2O_3$ (20) $SiO_2$ (45), $Al_2O_3$ (5) | 45 | THERMAL CVD METHOD MGO WITH (100)-FACE ORIENTATION |

TABLE 3-continued

| | | | | |
|---|---|---|---|---|
| 26 | THERMAL CVD METHOD | $Al_2O_3$ | 70 | THERMAL CVD METHOD MGO WITH (100)-FACE ORIENTATION |
| 27 | THERMAL SPRAYING METHOD | $P_2O_5$ (45), ZnO (34) $Al_2O_3$ (18), CaO (3) | 50 | PLASMA CVD METHOD MGO WITH (100)-FACE ORIENTATION |
| 28 | PLASMA CVD METHOD | $3Al_2O_3.2SiO_2$ | 50 | PLASMA CVD METHOD MGO WITH (100)-FACE ORIENTATION |
| 29 | THERMAL SPRAYING METHOD | PbO (30), $B_2O_3$ (20) $SiO_2$ (45), $Al_2O_3$ (5) | 45 | PLASMA CVD METHOD MGO WITH (100)-FACE ORIENTATION |
| 30 | THERMAL SPRAYING METHOD | $P_2O_5$ (45), ZnO (34) $Al_2O_3$ (18), CaO (3) | 50 | PLASMA CVD METHOD MGO WITH (100)-FACE ORIENTATION |
| 31 | PLASMA CVD METHOD | $SiO_2$ | 30 | PLASMA CVD METHOD MGO WITH (100)-FACE ORIENTATION |
| 32 | PLASMA CVD METHOD | $SiO_2$ | 30 | PLASMA CVD METHOD MGO WITH (100)-FACE ORIENTATION |
| 33* | THERMAL SPRAYING METHOD | PbO (30), $B_2O_3$ (20) $SiO_2$ (45), $Al_2O_3$ (5) | 45 | PLASMA CVD METHOD MGO WITH (100)-FACE ORIENTATION |
| 34* | PLASMA CVD METHOD | $Al_2O_3$ | 70 | PLASMA CVD METHOD MGO WITH (100)-FACE ORIENTATION |
| 35* | THERMAL SPRAYING METHOD | $P_2O_5$ (45), ZnO (34) $Al_2O_3$ (18), CaO (3) | 50 | PLASMA CVD METHOD MGO WITH (100)-FACE ORIENTATION |
| 36* | PLASMA CVD METHOD | $SiO_2$ | 30 | PLASMA CVD METHOD MGO WITH (100)-FACE ORIENTATION |

| EXAMPLE NUMBER | PARTITION WALL (FORMING METHOD AND MATERIAL) | PANEL WEIGHT (WITHOUT CIRCUIT) | PANEL STATE DURING OPERATION | CHANGING RATE OF PANEL BRIGHTNESS AFTER OPERATION ON 200 V FOR 5000 H (%) |
|---|---|---|---|---|
| 25 | THERMAL SPRAYING METHOD $Al_2O_3$ (ALUMINA) | 3.0 kg | NO CRACK IN DIELECTRIC GLASS | −2.9 |
| 26 | THERMAL SPRAYING METHOD $Al_2O_3$ (ALUMINA) | 2.1 kg | NO CRACK IN DIELECTRIC GLASS | −2.5 |
| 27 | THERMAL SPRAYING METHOD MULLITE ($3Al_2O_3$ .$2SiO_2$) | 3.9 kg | NO CRACK IN DIELECTRIC GLASS | −2.8 |
| 28 | THERMAL SPRAYING METHOD MULLITE ($3Al_2O_3$ .$2SiO_2$) | 2.6 kg | NO CRACK IN DIELECTRIC GLASS | −2.7 |
| 29 | THERMAL SPRAYING METHOD MULLITE ($3Al_2O_3$ .$2SiO_2$) | 3.1 kg | NO CRACK IN DIELECTRIC GLASS | −2.7 |
| 30 | THERMAL SPRAYING METHOD MULLITE ($3Al_2O_3$ .$2SiO_2$) | 1.54 kg | NO CRACK IN DIELECTRIC GLASS | −2.6 |
| 31 | THERMAL SPRAYING METHOD MULLITE ($3Al_2O_3$ .$2SiO_2$) | 4.1 kg | NO CRACK IN DIELECTRIC GLASS | −2.9 |
| 32 | THERMAL SPRAYING METHOD MULLITE ($3Al_2O_3$ .$2SiO_2$) | 0.28 kg | NO CRACK IN DIELECTRIC GLASS | −3.0 |
| 33* | THERMAL SPRAYING METHOD MULLITE ($3Al_2O_3$ .$2SiO_2$) | 7.4 kg | CRACK IN DIELECTRIC SUBSTANCE | CRACK IN PANEL |
| 34* | THERMAL SPRAYING METHOD MULLITE ($3Al_2O_3$ .$2SiO_2$) | 4.1 kg | CRACK IN PANEL | — |
| 35* | THERMAL SPRAYING METHOD MULLITE ($3Al_2O_3$ .$2SiO_2$) | 8.3 kg | CRACK IN DIELECTRIC SUBSTANCE | CRACK IN PANEL |
| 36* | THERMAL SPRAYING METHOD MULLITE ($3Al_2O_3$ .$2SiO_2$) | 5.0 kg | CRACK IN PANEL | — |

What is claimed is:

1. A method for producing a PDP comprising:

a first step of attaching a first electrode made of silver onto a main surface of a first plate and forming with a CVD method a layer made of a metallic oxide on a surface of the first electrode, wherein, on exposure to air, OH groups are generated on a surface of the layer made of the metallic oxide;

a second step of coating the layer made of the metallic oxide with a dielectric layer while OH groups exist on the surface of the layer made of the metallic oxide;

a third step of preparing a second plate; and a fourth step of placing the first plate and the second plate in parallel to face each other, with spacing means being placed between the first plate and the second plate, so that a discharge space is formed between the first plate and the second plate.

2. The method for producing a PDP defined in claim 1, wherein in the first step, either of a metal chelate and a metal alkoxide compound is used as a source material for the CVD method.

3. The method for producing a PDP defined in claim 1, wherein in the first step, a compound used as a source material for the CVD method is at least one of zinc, zirconium, magnesium, titanium, silicon, aluminium, and chromium.

4. The method for producing a PDP defined in claim 1, wherein in the second step, the dielectric layer is made of one of a lead oxide glass whose dielectric constant is 10 or more and a bismuth oxide glass whose dielectric constant is 10 or more, wherein the lead oxide glass includes lead oxide (PbO), boron oxide ($B_2O_3$), silicon oxide ($SiO_2$), and aluminum oxide ($Al_2O_3$), and the bismuth oxide glass includes bismuth oxide ($Bi_2O_3$), zinc oxide (ZnO), boron oxide ($B_2O_3$), silicon oxide ($SiO_2$), and calcium oxide (CaO).

* * * * *

UNITED STATES PATENT AND TRADEMARK OFFICE

CERTIFICATE OF CORRECTION

PATENT NO. : 6,419,540 B1
DATED : July 16, 2002
INVENTOR(S) : Hiroyoshi Tanaka et al.

It is certified that error appears in the above-identified patent and that said Letters Patent is hereby corrected as shown below:

Title page,
Item [62], Related U.S. Application Data delete "Dec. 12, 2000" and insert
-- Nov. 26, 1997 --

Signed and Sealed this

Eighth Day of April, 2003

JAMES E. ROGAN
*Director of the United States Patent and Trademark Office*